US011827255B2

(12) United States Patent
Green et al.

(10) Patent No.: US 11,827,255 B2
(45) Date of Patent: Nov. 28, 2023

(54) SYSTEM AND METHOD FOR VEHICLE CONTROL

(71) Applicant: THALES CANADA INC., Toronto (CA)

(72) Inventors: Alon Green, Toronto (CA); Dennis Yazhemsky, Toronto (CA); James Kevin Tobin, Toronto (CA)

(73) Assignee: THALES CANADA INC, Ontario (CA)

( * ) Notice: Subject to any disclaimer, the term of this patent is extended or adjusted under 35 U.S.C. 154(b) by 421 days.

(21) Appl. No.: 17/116,622

(22) Filed: Dec. 9, 2020

(65) Prior Publication Data

US 2021/0171077 A1 Jun. 10, 2021

Related U.S. Application Data

(60) Provisional application No. 62/945,662, filed on Dec. 9, 2019.

(51) Int. Cl.
*B61L 15/00* (2006.01)

(52) U.S. Cl.
CPC ..... *B61L 15/0063* (2013.01); *B61L 15/0018* (2013.01); *B61L 15/0072* (2013.01); *B61L 15/0081* (2013.01)

(58) Field of Classification Search
CPC ..... B61L 15/0063; B61L 15/0018; B61L 15/0072; B61L 15/0081; B61L 15/0036
See application file for complete search history.

(56) References Cited

U.S. PATENT DOCUMENTS 7,317,987 B2 1/2008 Nahla
8,649,916 B2 2/2014 Woo et al.
(Continued)

FOREIGN PATENT DOCUMENTS

DE 102016223737 A1 5/2018
EP 3240718 B1 2/2016
(Continued)

OTHER PUBLICATIONS

International Search Report and Written Opinion issued in corresponding International Application No. PCT/IB2020/061710, dated Feb. 22, 2021, pp. 1-11, Canadian Intellectual Property Office, Quebec, Canada.

(Continued)

*Primary Examiner* — Russell Frejd
(74) *Attorney, Agent, or Firm* — Hauptman Ham, LLP

(57) ABSTRACT

A system for controlling a vehicle includes at least one vehicle network on board the vehicle, first and second controllers coupled to the at least one vehicle network and configured to communicate with each other via the at least one vehicle network, and first and second sensor sets coupled to the at least one vehicle network, and configured to communicate with any of the first and second controllers via the at least one vehicle network. Each of the first and second controllers is configured to, based on data output from any of the first and second sensor sets, control a movement of the vehicle independently of the other of the first and second controllers. The first sensor set is located at a first location on the vehicle, the second sensor set is located at a second location on the vehicle, and the second location is different from the first location.

20 Claims, 16 Drawing Sheets

(56) References Cited

U.S. PATENT DOCUMENTS

| | | | | |
|---|---|---|---|---|
| 8,924,066 | B2 | 12/2014 | Fries | |
| 8,965,604 | B2 | 2/2015 | Nandedkar et al. | |
| 10,228,456 | B2 | 3/2019 | Runge et al. | |
| 10,315,673 | B2 | 6/2019 | Chung et al. | |
| 2019/0025839 | A1 | 1/2019 | Manjunath et al. | |
| 2019/0097932 | A1* | 3/2019 | Buczek ..... | B60W 30/00 |
| 2019/0100226 | A1 | 4/2019 | Baier et al. | |
| 2019/0100237 | A1 | 4/2019 | Klesing | |
| 2019/0126958 | A1 | 5/2019 | Braband et al. | |
| 2019/0248396 | A1 | 8/2019 | Khosla | |
| 2019/0256113 | A1 | 8/2019 | Filippone | |
| 2019/0270463 | A1 | 9/2019 | Goodermuth et al. | |
| 2019/0322292 | A1 | 10/2019 | Staab et al. | |
| 2019/0325754 | A1 | 10/2019 | Aoude et al. | |

FOREIGN PATENT DOCUMENTS

| | | | |
|---|---|---|---|
| EP | 3275764 | A1 | 7/2016 |
| WO | 2018036751 | A1 | 3/2018 |
| WO | 2018104454 | A2 | 6/2018 |

OTHER PUBLICATIONS

Thales Group, "Communications Based Train Control (CBTC) Signalling", Nov. 24, 2020, pp. 1-6, https://www.thalesgroup.com/en/communications-based-train-control-cbtc-signalling.

Liu et al., "A scenario-based safety argumentation for CBTC safety case architecture", 2010, pp. 1-12, WIT Transactions on the Built Environment, vol. 114.

* cited by examiner

SYSTEM AND METHOD FOR VEHICLE CONTROL

RELATED APPLICATION(S)

The present application claims the priority benefit of U.S. Provisional Patent Application No. 62/945,662, filed Dec. 9, 2019, the entirety of which is hereby incorporated by reference.

BACKGROUND

Commuter train networks represent a rapidly growing industry. This rapid growth of rail commuter transit is accompanied by development of autonomous rail vehicles which are often equipped with a vehicle onboard controller (VOBC), or simply controller, connected to a set of sensors. The set of sensors is often arranged at an end of the vehicle and provides measurements which are used by the controller to calculate various commands to control movement of the vehicle. To ensure safe autonomous operation of the vehicle, other approaches provide a redundant controller with its own redundant set of sensors arranged at the other end of the vehicle. The controllers are identical, are coupled to each other by a network on the vehicle, and are configured as checked-redundant controllers. Each controller has its own dedicated set of sensors that is neither shared with nor accessible by the other controller. The two set of sensors are identical.

BRIEF DESCRIPTION OF THE DRAWINGS

One or more embodiments are illustrated by way of example, and not by limitation, in the figures of the accompanying drawings, wherein elements having the same reference numeral designations represent like elements throughout. It is emphasized that, in accordance with standard practice in the industry various features may not be drawn to scale and are used for illustration purposes only. In fact, the dimensions of the various features in the drawings may be arbitrarily increased or reduced for clarity of discussion.

DETAILED DESCRIPTION

Figure 1:
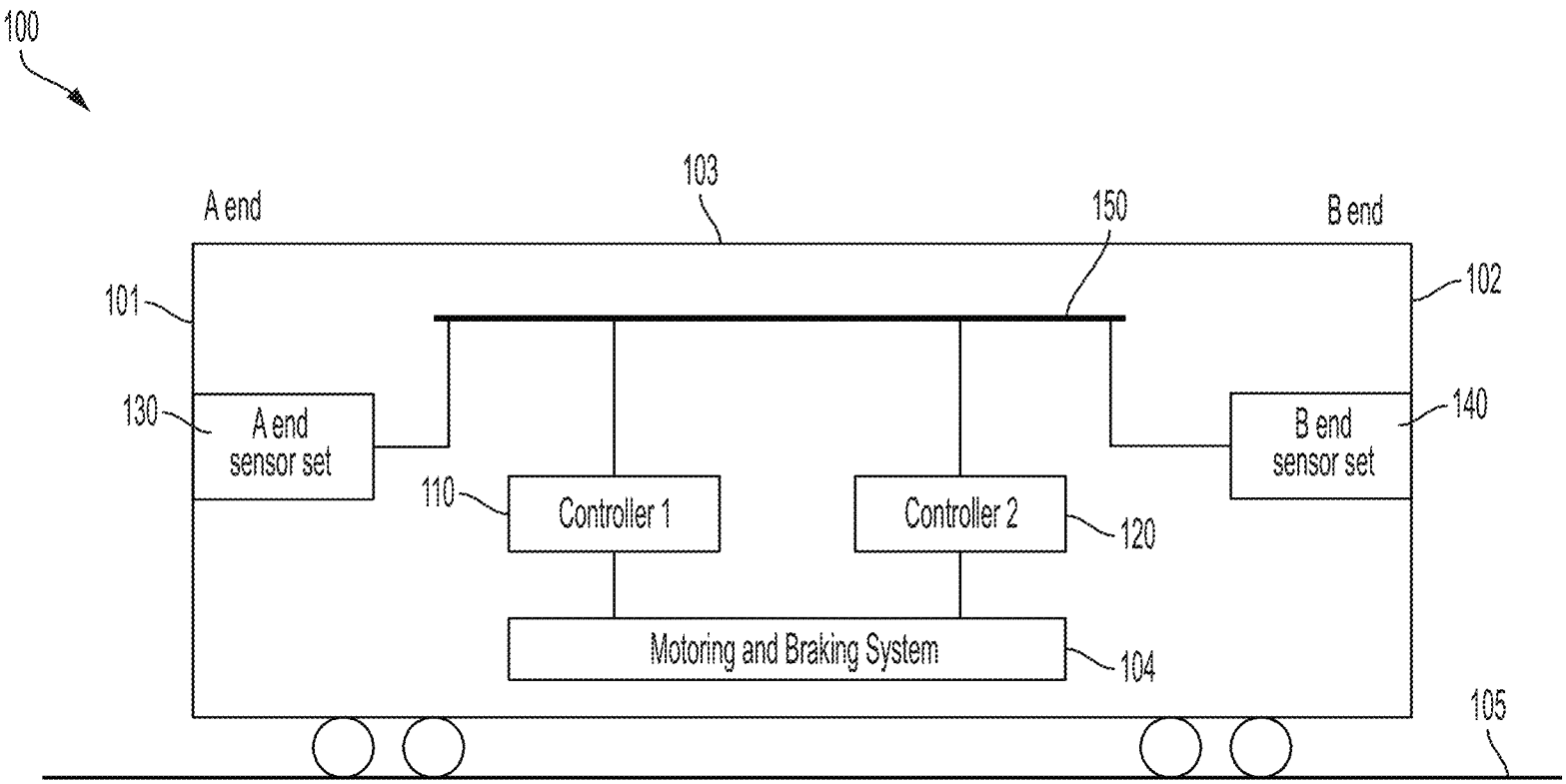
FIG. 1 is a schematic block diagram of a system for controlling a vehicle, in accordance with some embodiments.

The following disclosure provides many different embodiments, or examples, for implementing different features of the provided subject matter. Specific examples of components and arrangements are described below to simplify the present disclosure. These are, of course, merely examples and are not intended to be limiting. For example, the formation or position of a first feature over or on a second feature in the description that follows may include embodiments in which the first and second features are formed or positioned in direct contact, and may also include embodiments in which additional features may be formed or positioned between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of an apparatus, object in use or operation, or objects scanned in a three dimensional space, in addition to the orientation thereof depicted in the figures. The apparatus may be otherwise oriented (rotated 90 degrees or at other orientations) and the spatially relative descriptors used herein may likewise be interpreted accordingly.

In the known approach with two checked-redundant controllers each with its own dedicated set of sensors, if a single sensor within one set of sensors fails, then the controller associated with that set of sensors is not available any more even though this controller is still healthy. If another single sensor within the other set of sensors also fails, then the other controller associated with the other set of sensors is no longer available. Thus, there are situations where two sensor failures, each in one of the sets of sensors, result in non-availability of the whole system, with consequences that potentially affect the availability of the high level of safety integrity (e.g., SIL 4) protection functions and the safety level of operations of the vehicle.

The above and other concerns are addressed in some embodiments in which first and second sets of sensors (also referred to herein as "sensor sets") are coupled to a network on a vehicle and are available to each and any of first and second controllers also coupled to the network. As a result, if a sensor in one of the sensor sets fails, the corresponding sensor in the other sensor set is still available to both controllers which remain available to ensure the intended safe operations of the vehicle. For example, if a speed sensor in the first sensor set fails, the corresponding speed sensor in the second sensor set is still available to both controllers which, therefore, remain available. If another sensor of a different type (e.g., a position sensor) in the second sensor set also fails, the corresponding (position) sensor in the first sensor set is still available to both controllers which, therefore, remain available even though each sensor set includes a failed sensor. Accordingly, a safety integrity level of the whole system is improved in at least one embodiment. In some embodiments, the safety integrity level 4 (SIL 4) is achieved. In one or more embodiments, SIL 4 is based on International Electrotechnical Commission's (IEC) standard IEC 61508 and European Committee for Electrotechnical Standardization's (CENELEC) EN 50126 and EN50129. SIL 4 means the probability of failure per hour ranges from $10^{-8}$ to $10^{-9}$. Other advantages are achievable in one or more embodiments as described herein.

FIG. 1 is a schematic block diagram of a system 100 for controlling a vehicle 103, in accordance with some embodiments.

The vehicle 103 has a first end 101, and a second end 102 different from the first end 101. In the example configuration in FIG. 1, the second end 102 is the opposite end to the first end 101. For example, if the first end 101 is the leading end of the vehicle 103, then the second end 102 is the trailing end of the vehicle 103, and vice versa. The first end 101 is schematically indicated in the drawings as "A end," and the second end 102 is schematically indicated in the drawings as "B end." In some embodiments, the vehicle 103 is configured to transport people and/or cargo. Examples of the vehicle 103 include, but are not limited to, trains, wagons, motorcycles, cars, trucks, buses, ships, boats, airplanes, helicopters, or the like.

The vehicle 103 further comprises a motoring and braking system 104 for driving the vehicle 103 to move along a path 105. The motoring and braking system 104 comprises a propulsion source configured to generate a force or acceleration to move the vehicle 103 along the path 105. Examples of a propulsion source include, but are not limited to, an engine or an electric motor. The motoring and braking system 104 further comprises a break for decelerating and stopping the vehicle 103. Other movements of the vehicle 103 are also effected by the motoring and braking system 104 in various embodiments. For example, in embodiments where steering of the vehicle 103 (e.g., a road vehicle) is possible, the motoring and braking system 104 also includes a steering mechanism for steering the vehicle 103.

In some embodiments, the path 105 is a guideway. Examples of a guideway include, but are not limited to, is a track, rail, roadway, cable, series of reflectors, series of signs, a visible or invisible path, a projected path, a laser-guided path, a global positioning system (GPS)-directed path, an object-studded path or other suitable format of guide, path, track, road or the like on which, over which, below which, beside which, or along which a vehicle is caused to travel. In some embodiments, the vehicle 103 is a railway vehicle, such as, a train. While trains are a practical application of some embodiments, at least one embodiment has a practical application in road vehicles, such as autonomous cars. In some embodiments, the vehicle 103 comprises one or more autonomous cars travelling on a guideway, especially in the form of a fleet of vehicle one following another.

The system 100 for controlling the vehicle 103 comprises a first controller 110, a second controller 120, a first sensor set 130, a second sensor set 140, and at least one network 150. The network 150 is installed on board the vehicle 103, and is also referred to herein as "vehicle network." The network 150 includes at least one wired network and/or at least one wireless network. Example wired networks include, but are not limited to, ETHERNET, USB, IEEE-1394, or the like. Example wireless networks include, but are not limited to, BLUETOOTH, WIFI, LTE, 5G, WIMAX, GPRS, WCDMA, or the like.

The first controller 110 and the second controller 120 are coupled to the network 150 and are configured to communicate with each other via the network 150. The first sensor set 130 and the second sensor set 140 are also coupled to the network 150, and are configured to communicate with any of the first sensor set 130 and the second sensor set 140 via the network 150.

Each of the first controller 110 and the second controller 120 is configured to, based on data output from any of the first sensor set 130 and the second sensor set 140, to control a movement of the vehicle 103 independently of the other controller. In some embodiments, only one controller is actively controlling the vehicle at a certain time For example, each of the first controller 110 and the second controller 120 is coupled to the motoring and braking system 104 to output commands, based on the data output from any of the first sensor set 130 and the second sensor set 140 and independently from the other controller, to control acceleration, deceleration, speed, braking of the vehicle 103. As a result, if one of the first controller 110 and the second controller 120 fails, the remaining controller is still available to control the movement of the vehicle 103. In the example configuration in FIG. 1, the first controller 110 and the second controller 120 are coupled to the motoring and braking system 104, for example, via a relay or a relays set. Other configurations are within the scopes of various embodiments. For example, in at least one embodiment, the first controller 110 and/or the second controller 120 is/are coupled to the motoring and braking system 104 via the network 150. In some embodiments, each of the first controller 110 and the second controller 120 comprises at least one processor, or at least one processor and at least one micro-controller (MCU), or at least one processor and at least one cluster of Graphics Processing Unit/Vector Arithmetic Accelerator (GPU/VAT), or at least one processor, at least one micro-controller and at least one cluster of GPU/VAT. In at least one embodiment, each of the first controller 110 and the second controller 120 comprises at least one computing platform as described with respect to FIG. 11. Other configurations for a controller are within the scopes of various embodiments, for example, as described with respect to FIG. 8. In some embodiments, the first controller 110 is identical to the second controller 120. In one or more embodiments, a power supply of the first controller 110 is separate and isolated from a power supply of the second controller 120. In at least one embodiment, the first controller 110 and/or the second controller 120 is/are implemented as part of a VOBC of the vehicle 103. The first controller 110 is indicated in the drawings as "Controller 1," and the second controller 120 is indicated in the drawings as "Controller 2."

The first sensor set 130 is located at a first location on the vehicle 103, the second sensor set 140 is located at a second location on the vehicle 103, and the second location is different from the first location. In at least one embodiment, the first location is spaced from the second location along a length direction or a travel direction of the vehicle 103. In the example configuration in FIG. 1 and/or one or more other figures, the first sensor set 130 is located at the first end 101 and is indicated in the drawings as "A end sensor set," whereas the second sensor set 140 is located at the second end 102 and is indicated in the drawings as "B end sensor set." In at least one embodiment, one of the first sensor set 130 and the second sensor set 140 is located at a leading end of the vehicle 103, whereas the other of the first sensor set 130 and the second sensor set 140 is located at a trailing end of the vehicle 103, when the vehicle 103 travels along the path 105. However, other physical locations of the first sensor set 130 and/or the second sensor set 140 are within the scopes of various embodiments. For example, in some embodiments, the first sensor set 130 and the second sensor set 140 are located at different locations on a same wagon of a train. In one or more embodiments, the first sensor set 130 and the second sensor set 140 are located in different wagons of a train. In at least one embodiment, the first sensor set 130 is located at the first wagon of a train, and the second sensor set 140 is located at the last wagon of the train. In at least one embodiment, the first sensor set 130 and the second sensor set 140 are located at the opposite extremities of the train. While the first sensor set 130 and the second sensor set 140 are physically arranged at different locations on the vehicle 103, physical locations of the first controller 110 and/or the second controller 120 are not so limited. For example, in at least one embodiment, the first controller 110 and the second controller 120 are located at the same physical location on the vehicle 103. In some embodiments, the first controller 110, the second controller 120 and/or parts of the first controller 110 and/or the second controller 120 are distributed at various locations on the vehicle 103.

Each of the first controller 110 and the second controller 120 is configured to perform a plurality of functions for controlling the movement of the vehicle 103. The plurality of functions includes one or more of (1) odometry, (2) positioning, (3) obstacle avoidance, (4) motion direction, (5) orientation, (6) stationary, (7) cold motion. In some embodiments, to ensure an intended level of autonomous operations of the vehicle 103, each of the first controller 110 and the second controller 120 is configured to perform all functions (1)-(7). Function (1), i.e., odometry, is a function in which the first controller 110 or the second controller 120 is configured to determine the speed and motion direction of the vehicle 103. In most cases, function (6) stationary and function (7) cold motion are related to this function (1). Function (2), i.e., positioning, is a function in which the first controller 110 or the second controller 120 is configured to determine the position of the vehicle 103 on the path 105, e.g., the guideway or road, and the orientation of the vehicle 103 on the guideway or road. Function (3), i.e., obstacle avoidance, is a function in which the first controller 110 or the second controller 120 is configured to determine if another object, such as another vehicle, is in collision course with the vehicle 103 and to stop the vehicle 103 if such situation is determined. Function (4), i.e., motion direction detection, is a function in which the first controller 110 or the second controller 120 is configured to detect the direction the vehicle 103 is moving relative to its own coordinate system. For example, if a motion vector is from end B to end A then forward motion is detected, and if the motion vector is from end A to end B then reverse motion is detected. Function (5), i.e., stationary state determination, is a function in which the first controller 110 or the second controller 120 is configured to determine whether the vehicle 103 is stand still. For example, the vehicle 103 is determined to be stand still when the vehicle 103 has a speed consistently less than 0.5 km/h and an accumulative displacement less than 3 cm.

Function (6), i.e., cold motion detection, is a function in which the first controller 110 or the second controller 120 is configured to detect motion of the vehicle 103 while the system is shutoff, i.e., while the controller is shutoff or in sleep mode.

Function (7), i.e., orientation detection, is a function in which the first controller 110 or the second controller 120 is configured to detect the orientation of the vehicle on the guideway and its correlation with the direction the vehicle 103 is moving relative to a coordinate system of the guideway or road.

Each of the first sensor set 130 and the second sensor set 140 comprises a plurality of sensors configured to provide sufficient data for each and any of the first controller 110 and the second controller 120 to perform the plurality of functions for controlling the movement of the vehicle 103, as described herein. The data (also referred herein as "sensor data") provided by each of the first sensor set 130 and the second sensor set 140 comprise measured or detected values of a plurality of parameters. Example parameters include, but are not limited to, a current speed of the vehicle 103, a current position of the vehicle 103 on the path 105, a current acceleration (or deceleration) of the vehicle 103, or the like. To detect or measure values of the parameters, each of the first sensor set 130 and the second sensor set 140 comprises corresponding sensors. For example, to detect or measure the speed of the vehicle 103, each of the first sensor set 130 and the second sensor set 140 comprises one or more speed sensors including, but not limited to, a Doppler radar, a camera (video odometry), Light Detection And Ranging (LiDAR) equipment, or the like. For another example, to detect or measure the position of the vehicle 103 on the path 105, each of the first sensor set 130 and the second sensor set 140 comprises one or more position sensors including, but not limited to, a camera, a radar, a LiDAR scanner, a radio frequency (RF) transceiver, or the like, for reading corresponding visible, radar, LiDAR or RF data embedded in one or more signs arranged along the path 105, in an arrangement known as a communication based train control (CBTC) system. For a further example, to detect or measure the acceleration (or deceleration) of the vehicle 103, each of the first sensor set 130 and the second sensor set 140 comprises an accelerometer or Inertial Measurement Unit (IMU) sensor on the vehicle 103. Other parameters to be measured or detected, and the corresponding sensors for measuring or detecting such parameters, are within the scopes of various embodiments. In some embodiments, the first sensor set 130 is identical to the second sensor set 140.

The sensor data measured, detected or otherwise collected by each of the first sensor set 130 and the second sensor set 140 are provided to any of the first controller 110 and the second controller 120 via the network 150. Each of the first controller 110 and the second controller 120 is configured to, based on the provided sensor data, perform the plurality of functions as described herein to control the movement of the vehicle 103. In some embodiments, each of the first controller 110 and the second controller 120 is configured to perform computation, based on the sensor data provided from the first sensor set 130 and/or the second sensor set 140, to generate commands for the motoring and braking system 104. In some embodiments, the computation performed by each of the first controller 110 and the second controller 120 includes solving an optimization problem based on a current state of the vehicle 103, to meet at least one control objective. In at least one embodiment, the optimization problem is solved under at least one constraint. In an example, the current state includes the current speed and the current position of the vehicle 103. Example control objectives include, but are not limited to, minimum amount of time to drive the vehicle 103 from a start location to a target location on the path 105, minimum amount of energy consumption to drive the vehicle 103 from the start location to the target location, minimum excessive braking along the path 105, or the like. Example constraints include, but are not limited to, trip constraints, track constraints, vehicle constraints, or the like. Examples of trip constraints include, but are not limited to, maximum and minimum arrival times at a location on the path 105, and constraints on braking. Examples of track constraints include, but are not limited to, maximum allowable speed limit, friction, traction or grade profile of the path 105. Examples of vehicle constraints include, but are not limited to, maximum braking force, maximum acceleration (or propulsion) force, vehicle mass, latencies/delays in the motoring and braking system 104. One or more algorithm for solving the optimization problem is/are programmed or hardwired in the first controller 110 and the second controller 120. Based on the solution to the optimization problem, the first controller 110 and/or the second controller 120 is configured to output commands to the motoring and braking system 104 to cause the motoring and braking system 104 to generate a propulsion or braking force to achieve the optimal time, position, speed or acceleration corresponding to the solution to the optimization problem. One or more examples of the computation performed the first controller 110 and the second controller 120, e.g., for solving an optimization problem, are described in the U.S. patent application Ser. No. 16/436,440, filed Jun. 10, 2019, titled "CONTROLLER, SYSTEM AND METHOD FOR VEHICLE CONTROL", which is incorporated by reference herein in its entirety.

In some embodiments, as described herein, one of the first controller 110 and the second controller 120 is active at a certain time. The commands output by the active controller, e.g., by the first controller 110, are used to control the motoring and braking system 104. In situations where the active controller, i.e., the first controller 110, becomes unavailable or faulty, the commands output by other controller, i.e., the second controller 120, are used to control the motoring and braking system 104, thereby achieving an intended system availability. In at least one embodiment, the first controller 110 and the second controller 120 are configured to ensure that one of the controllers is active at a certain time, e.g., by way of a relay or a relay set serving as the interface between the controllers 110, 120 and the motoring and braking system 104.

In at least one embodiment, a controller is determined to be unavailable or faulty when its on-line built-in tests detects a failure such as a failure in its memory, or an inconsistency in the attributes calculated is detected such as the calculated speed or position.

As described herein, the sensor data measured, detected or otherwise collected by each of the first sensor set 130 and the second sensor set 140 are provided to any of the first controller 110 and the second controller 120 via the network 150. In some embodiments, by default, the first controller 110 receives data from one of the sensor sets, e.g., the first sensor set 130, whereas the second controller 120 receives data from the other sensor set, e.g., the second sensor set 140. In situations where a sensor (e.g., a speed sensor) in the first sensor set 130 is determined to be unavailable or faulty, the first controller 110 is switched to using the speed data of the second sensor set 140 together with data of other, healthy sensors in the first sensor set 130, for its computation. Alternatively, when a sensor in the first sensor set 130 is determined to be unavailable or faulty, the first controller 110 is switched to using all data of the second sensor set 140 for its computation. The second sensor set 140 is similarly configured to switch from using data of its default second sensor set 140 to using data of the first sensor set 130 when a sensor in its default second sensor set 140 becomes unavailable or faulty.

In at least one embodiment, a sensor is determined to be unavailable when the sensor stops outputting data of the corresponding parameter. In some embodiments, a sensor is determined to be faulty by comparing data output from at least two identical sensors in the first sensor set 130 or from at least two identical sensors in the second sensor set 140, e.g., by at least one of the first controller 110 or the second controller 120. When the sensor data output from the at least two identical sensors in first sensor set 130 or from the at least two identical sensors in the second sensor set 140 match, or their differences fall within a predetermined, acceptable tolerance range, the first sensor set 130 or the second sensor set 140 is determined to be healthy. However, when a difference between the sensor data for a parameter, e.g., speed, output from the first sensor of certain type in the sensor set 130 and the corresponding (speed) data output from the second sensor of the same type in the same sensor set 130 is outside the predetermined, acceptable tolerance range, it is determined that the speed sensors in the first sensor set 130 are faulty. Alternatively, when a difference between the sensor data for a parameter, e.g., speed, output from the first sensor of certain type in the second sensor set 140 and the corresponding (speed) data output from the second sensor of the same type in the same sensor set 140 is outside the predetermined, acceptable tolerance range, it is determined that the speed sensors in the second sensor set 140 are faulty. Additionally or alternatively, the speed data from the speed sensors in the first sensor set 130, and the speed data from the speed sensors in the second sensor set 140 are compared with expected speed data which are determined based on the most recent, previous speed data detected when both speed sensors in the first sensor set 130 or the second sensor set 140 were still healthy. When the difference is outside a predetermined, acceptable tolerance range, both speed sensors in the sensor set are determined to be faulty.

As described herein, by making all sensors in the first sensor set 130 and the second sensor set 140 available on the network 150 to be used by any of the first controller 110 and the second controller 120, it is possible, in at least one embodiment, to ensure a high level of system availability, i.e., one or both of the first controller 110 and the second controller 120 remain(s) available to control the motoring and braking system 104, despite double sensor failures each in one of the first sensor set 130 and the second sensor set 140. This is an improvement over the known approach in which each controller has its own sensor set and, therefore, system unavailability potentially occurs when each sensor set experiences a single sensor failure. In some embodiments, the safety integrity level 4 (SIL 4) is achieved.

Figure 2A:
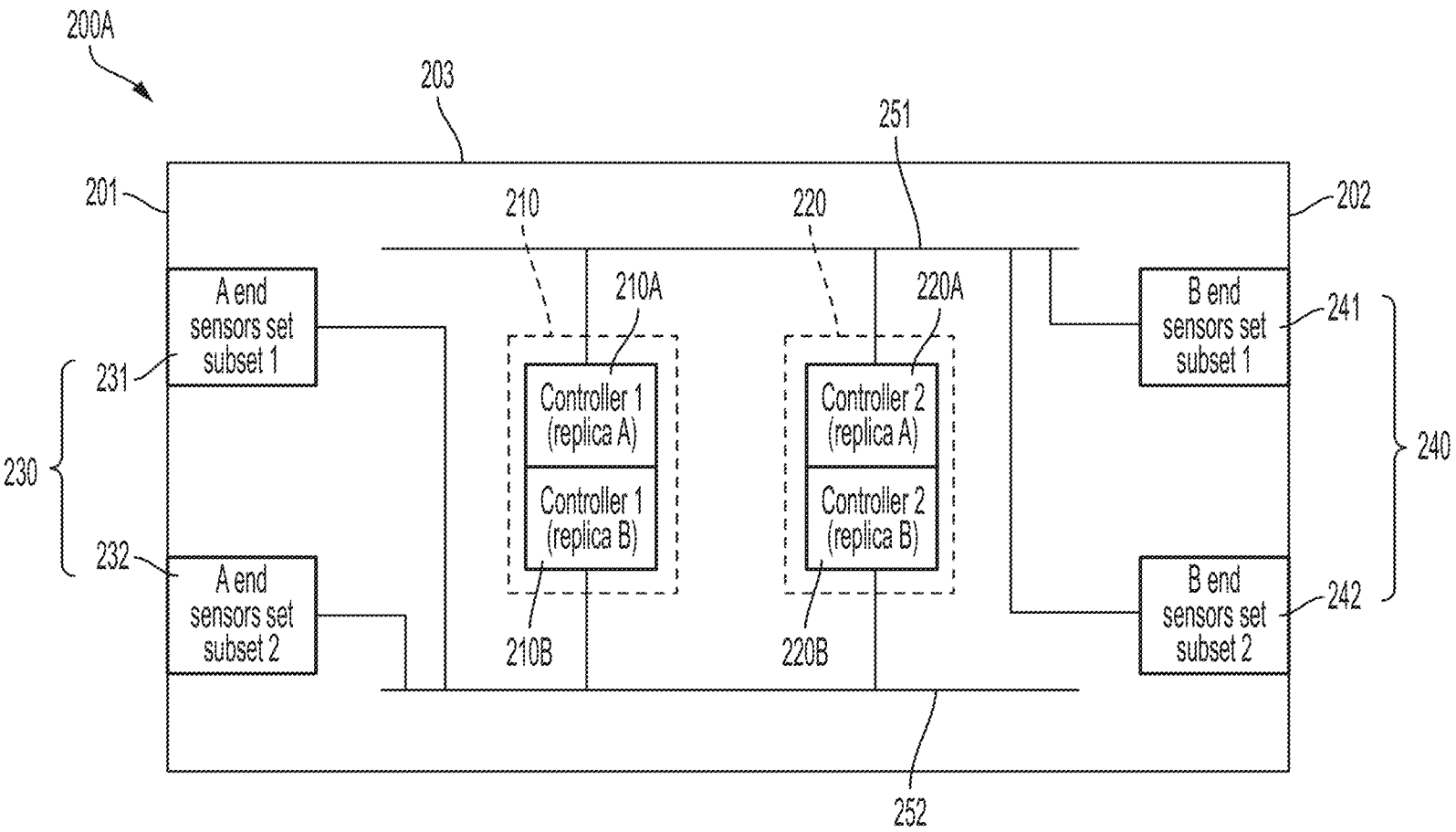
FIGS. 2A-2C are schematic block diagrams of various systems for controlling a vehicle, in accordance with some embodiments.
Figure 2B:
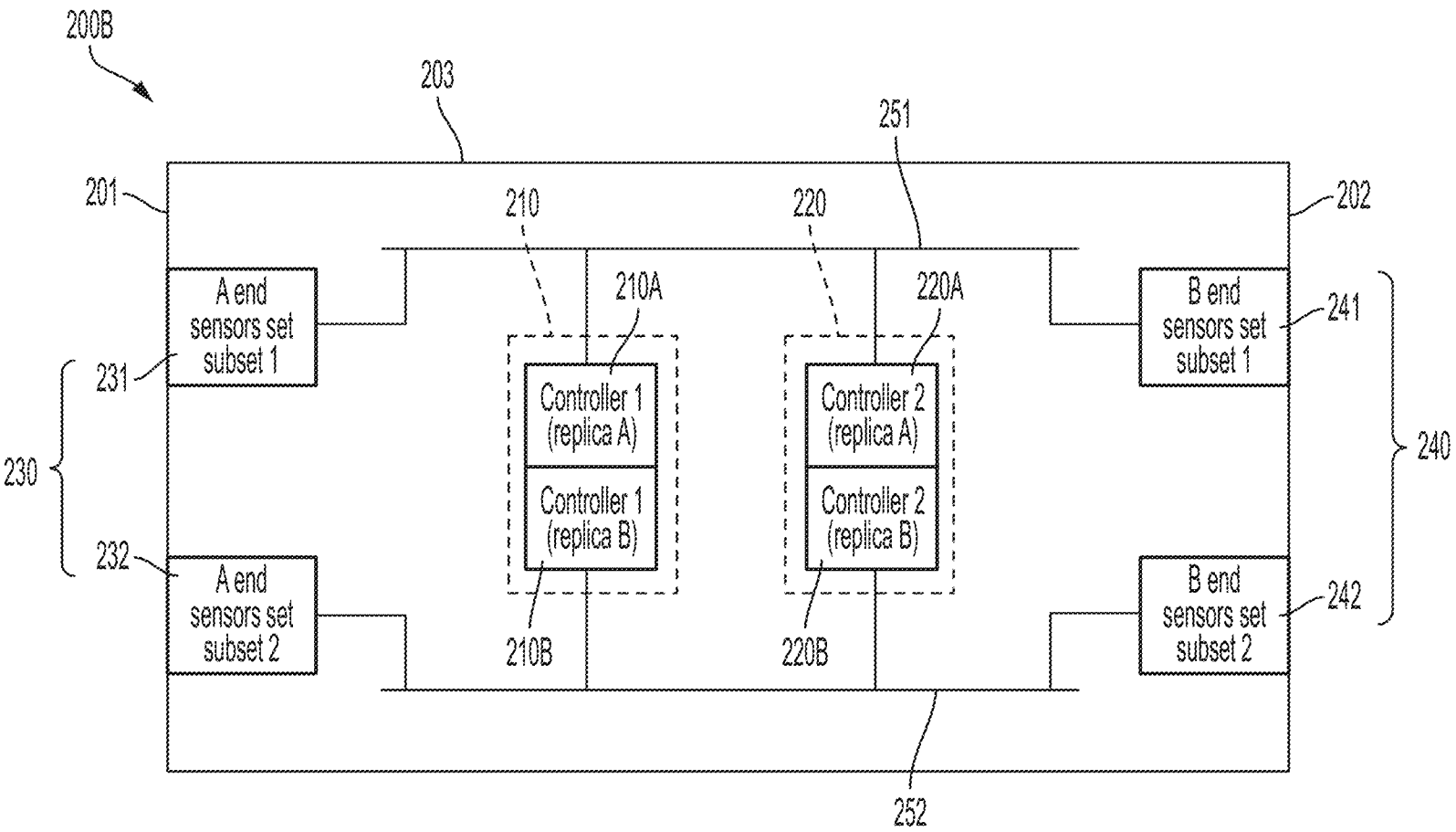
Figure 2C:
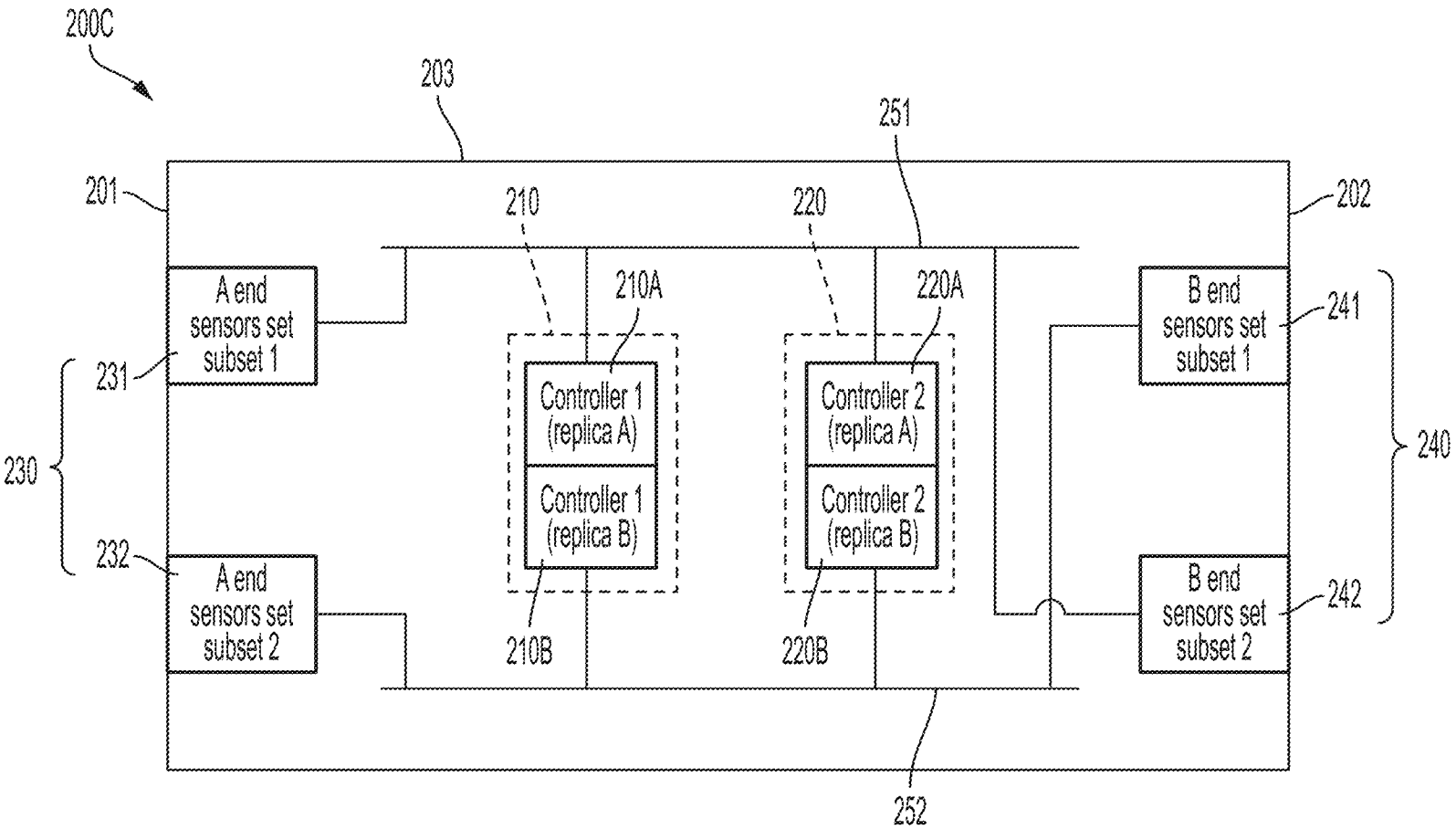

FIGS. 2A-2C are schematic block diagrams of various systems 200A-200C for controlling a vehicle, in accordance with some embodiments. Components in FIGS. 2A-2C having corresponding components in FIG. 1 are designated by the reference numerals of FIG. 1 increased by 100. Corresponding components in FIGS. 2A-2C are designated by the same reference numerals.

In FIG. 2A, the system 200A comprises a first controller 210, a second controller 220, a first sensor set 230, a second sensor set 240, and vehicle networks 251, 252 all of which are installed on a vehicle 203 having a first end 201 and a second end 202. In some embodiments, the first controller 210, the second controller 220, the first sensor set 230, the second sensor set 240, the vehicle 203, the first end 201, and the second end 202 correspond to the first controller 110, the second controller 120, the first sensor set 130, the second sensor set 140, the vehicle 103, the first end 101 and the second end 102. The networks 251, 252 correspond to the network 150. The vehicle 203 further comprises a motoring and braking system (not shown) corresponding to the motoring and braking system 104.

The first controller 210 comprises first and second controller replicas 210A, 210B which are identical to each other. In some embodiments, a replica is a single computing element in a multi computing elements computer. The first and second controller replicas 210A, 210B of the first controller 210 are correspondingly indicated in the drawings as "Controller 1 (replica A)" and "Controller 1 (replica B)." Each of the controller replicas 210A, 210B is configured to perform all functions of the first controller 210. Example functions of are described with respect to the first controller 110, and include, but are not limited to, odometry, positioning, obstacle avoidance, motion direction, orientation, stationary and cold motion functions, as well as computation based on sensor data from any of the first sensor set 230 and the second sensor set 240 to control the motoring and braking system of the vehicle 203. In one or more embodiments, a power supply of the controller replica 210A is separate and isolated from a power supply of the controller replica 210B. The controller replica 210A is coupled to the network 251, and the controller replica 210B is coupled to the network 252. In some embodiments, the networks 251, 252 are separated and isolated from each other. As a result, in at least one embodiment, the controller replicas 210A, 210B are separated and isolated from each other in terms of both power supply and communication. In other words, the controller replicas 210A, 210B are physically independent from each other.

The second controller 220 comprises first and second controller replicas 220A, 220B which are identical to each other. The first and second controller replicas 220A, 220B of the second controller 220 are correspondingly indicated in the drawings as "Controller 2 (replica A)" and "Controller 2 (replica B)." Each of the controller replicas 220A, 220B is configured to perform all functions of the second controller 220. Example functions of are described with respect to the second controller 120, and include, but are not limited to, odometry, positioning, obstacle avoidance, motion direction, orientation, stationary and cold motion functions, as well as computation based on sensor data from any of the first sensor set 230 and the second sensor set 240 to control the motoring and braking system of the vehicle 203. In one or more embodiments, a power supply of the controller replica 220A is separate and isolated from a power supply of the controller replica 220B. The controller replica 220A is coupled to the network 251, and the controller replica 220B is coupled to the network 252. As a result, in at least one embodiment, the controller replicas 220A, 220B are separated and isolated from each other in terms of both power supply and communication. In other words, the controller replicas 220A, 220B are physically independent from each other. An example configuration of one or more of the controller replicas 210A, 210B, 220A, 220B is described with respect to FIG. 8.

The first sensor set 230 is installed at the first end 201 of the vehicle 203. Other physical locations of the first sensor set 230 are within the scopes of various embodiments. The first sensor set 230 comprises first and second sensor subsets 231, 232 which are identical to each other. The first and second sensor subsets 231, 232 of the first sensor set 230 are correspondingly indicated in the drawings as "A end sensors set subset 1" and "A end sensors set subset 2." Each of the first and second sensor subsets 231, 232 includes sensors configured to provide sufficient data for each and any of the first controller 210 and second controller 220 to perform their functions as described herein. In some embodiments, each of the first and second sensor subsets 231, 232 comprises the same set of sensors as the first sensor set 130. Both the first and second sensor subsets 231, 232 are coupled to the network 252, and configured to provide sensor data to the controller replica 210B of the first controller 210 and the controller replica 220B of the second controller 220.

The second sensor set 240 is installed at the second end 202 of the vehicle 203. Other physical locations of the second sensor set 240 are within the scopes of various embodiments. The second sensor set 240 comprises first and second sensor subsets 241, 242 which are identical to each other. The first and second sensor subsets 241, 242 of the second sensor set 240 are correspondingly indicated in the drawings as "B end sensors set subset 1" and "B end sensors set subset 2." Each of the first and second sensor subsets 241, 242 includes sensors configured to provide sufficient data for each and any of the first controller 210 and second controller 220 to perform their functions as described herein. In some embodiments, each of the first and second sensor subsets 241, 242 comprises the same set of sensors as the second sensor set 140. Both the first and second sensor subsets 241, 242 are coupled to the network 251, and configured to provide sensor data to the controller replica 210A of the first controller 210 and the controller replica 220A of the second controller 220. In at least one embodiment, the minimum number of sensor subsets per a particular end of the vehicle 203 is two (2).

In normal operation, each of the controller replicas 210A, 210B, 220A, 220B is configured to, independently from one another, perform computation based on the corresponding sensor data provided from any of the first sensor set 230, second sensor set 240, and to output commands for controlling the motoring and braking system of the vehicle 203, as described with respect to the first controller 110, second controller 120. When a controller replica or a sensor in a sensor subset is determined as being unavailable or faulty, system availability is maintained by the remaining sensor subset(s) and/or controller replica(s). In at least one embodiment, one or more advantages described herein with respect to the system 100 are achievable in the system 200A. In at least one embodiment, SIL 4 is achieved.

In at least one embodiment, system availability is maintained in the system 200A under any combination of two sensor failures. For example, even when both speed sensors in the first and second sensor subsets 231, 232 fail, the speed sensors in the first and second sensor subsets 241, 242 remain and provide speed data for the controller replicas 210A, 220A via the network 251 to ensure safe autonomous operations of the vehicle 203. For another example, even when two speed sensors in the first sensor subsets 231, 241 fail, the speed sensors in the second sensor subsets 232, 242 remain and provide speed data for all controller replicas 210A, 210B, 220A, 220B via the networks 251, 252 to ensure safe autonomous operations of the vehicle 203.

In at least one embodiment, the provision of multiple controller replicas of the first controller 210 and second controller 220 and the multiple sensor subsets of the first sensor set 230 and second sensor set 240 for redundancy purposes in the system 200A further improve the safety integrity level in one or more embodiments. In at least one embodiment, the system 200A ensures safe operations of the vehicle 203 even at multiple sensor and/or controller replica failures. In some embodiments, the availability of a minimum of two sensor subsets and two controller replicas is all that is needed to ensure safe operations of the vehicle 203. The available sensor sets may be both first and second sensor subsets 231, 232 in the first sensor set 230, or both first and second sensor subsets 241, 242 in the second sensor set 240, or one sensor subset in the first sensor set 230 and one sensor subset in the second sensor set 240.

In FIG. 2B, the system 200B is different from the system 200A in the connections of the sensor subsets to the vehicle networks. Specifically, instead of the connections of both the first and second sensor subsets 231, 232 of the first sensor set 230 to the network 252 as in the system 200A, the first and second sensor subsets 231, 232 of the first sensor set 230 in the system 200B are correspondingly coupled to the networks 251, 252. Similarly, instead of the connections of both the first and second sensor subsets 241, 242 of the second sensor set 240 to the network 251 as in the system 200A, the first and second sensor subsets 241, 242 of the second sensor set 240 in the system 200B are correspondingly coupled to the networks 251, 252. In at least one embodiment, one or more advantages described herein with respect to the system 200A are achievable in the system 200B.

In FIG. 2C, the system 200C is different from the system 200B in the connections of the sensor subsets to the vehicle networks. Specifically, instead of the connections of the first and second sensor subsets 241, 242 of the second sensor set 240 in the system 200B correspondingly to the networks 251, 252, the first and second sensor subsets 241, 242 of the second sensor set 240 in the system 200C are correspondingly coupled to the networks 252, 251. In at least one embodiment, one or more advantages described herein with respect to the system 200B are achievable in the system 200C.

Compared to the system 200A, the system 200B or system 200C provides spatial diversity to the sensor set arrangement, because each of the controller replicas 210A, 210B, 220A, 220B is provided with sensor data from both ends 201, 202 of the vehicle 203. As a result, it is possible to collect sensor data from completely two different viewpoints, e.g., from the opposite ends of the vehicle 203. An example includes measuring the vehicle speed with a Doppler radar installed on the A end of the vehicle and with another Doppler radar installed on the B end of the vehicle. In some embodiments where a control system for a vehicle is configured to optimally operate with one sensor subset at the A end of the vehicle and another sensor subset at the B end of the vehicle to achieve spatial diversity, the system 200B or system 200C is preferred. In some embodiments where a control system for a vehicle is configured to optimally operate with two sensor subsets at the same end of the vehicle, the system 200A is preferred.

The described configurations in FIGS. 2A-2C with two sensor subsets in each of the first sensor set 230, second sensor set 240, and two controller replicas in each of the first controller 210, second controller 220 are examples. Other configurations where each sensor set has more than two sensor subsets and/or each controller has more than two controller replicas are within the scopes of various embodiments.

Figure 3:
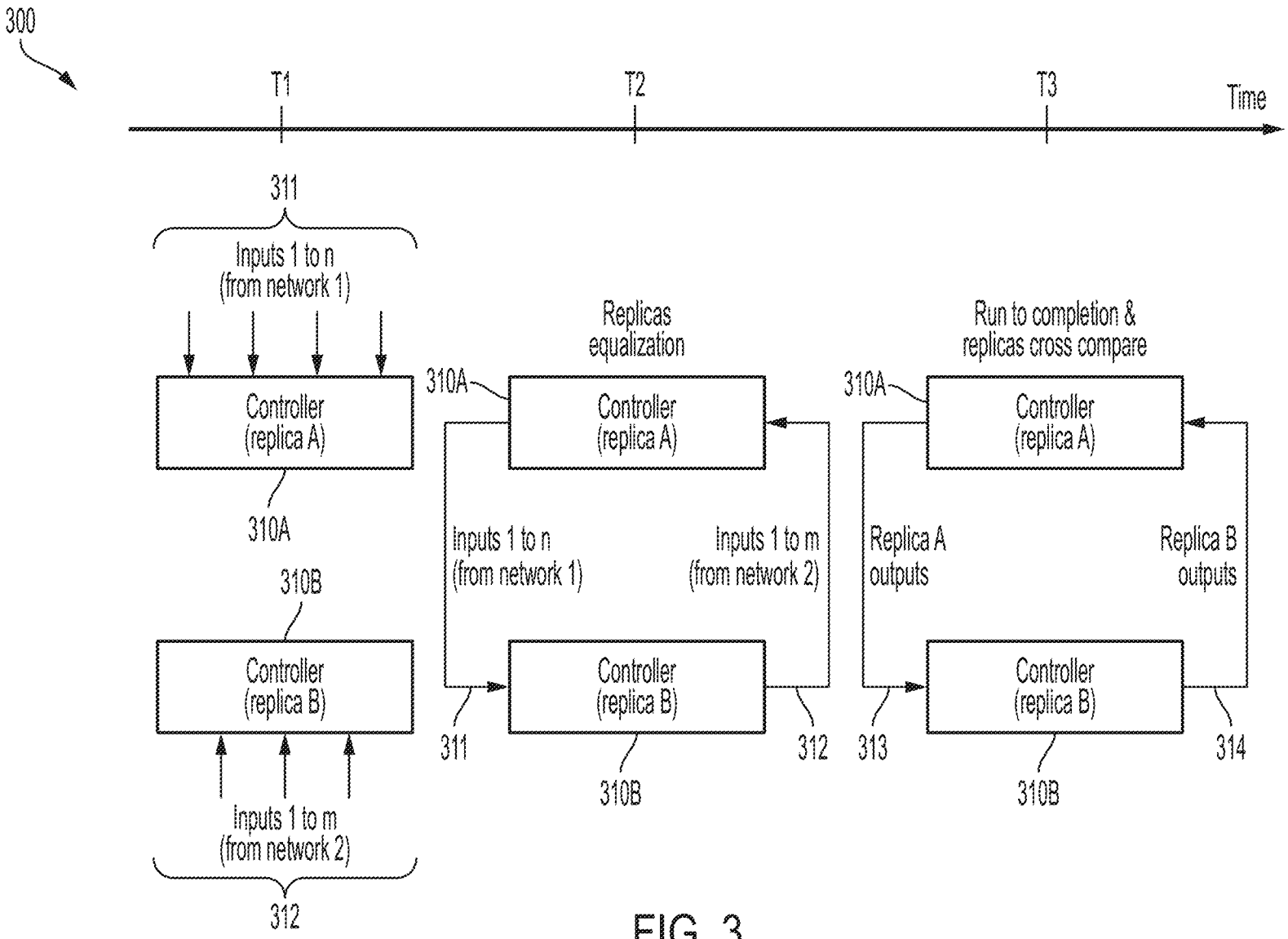
FIG. 3 is a schematic diagram of operations of a controller in a system for controlling a vehicle, in accordance with some embodiments.

FIG. 3 is a schematic diagram of operations of a controller 300 in a system for controlling a vehicle, in accordance with some embodiments. In some embodiments, the controller 300 corresponds to one or more of the first controller 210 and the second controller 220 in one or more of the systems 200A-200C.

The controller 300 comprises first and second controller replicas 310A, 310B which are identical to each other. The first and second controller replicas 310A, 310B are correspondingly indicated in the drawings as "Controller (replica A)" and "Controller (replica B)." In at least one embodiment, the controller replica 310A corresponds to one or more of the controller replicas 210A and 220A, and the controller replica 310B corresponds to one or more the controller replicas 210B and 220B. The controller replica 310A is coupled to a first network corresponding to, e.g., the network 251. The controller replica 310B is coupled to a second network corresponds to, e.g., the network 252.

During operation of the controller 300, at a timing generally indicated by T1, the controller replica 310A receives, a first set of inputs 311, e.g., inputs 1 to n, from the first network. In an example where the controller 300 is implemented in the system 200A, the first set of inputs 311 includes sensor data from one end of the vehicle, e.g., from the sensor subsets 241 and 242 at the second end 202. In a further example where the controller 300 is implemented in the system 200B or 200C, the first set of inputs 311 includes sensor data from both ends of the vehicle, e.g., from one sensor subset 231 at the first end 201 and from one sensor subset 241 or 242 at the second end 202.

At or about the same timing T1 or a different timing, the controller replica 320A receives, a second set of inputs 312, e.g., inputs 1 to m, from the second network. In an example where the controller 300 is implemented in the system 200A, the second set of inputs 312 includes sensor data from one end of the vehicle, e.g., from the sensor subsets 231 and 232 at the first end 201. In a further example where the controller 300 is implemented in the system 200B or 200C, the second set of inputs 312 includes sensor data from both ends of the vehicle, e.g., from one sensor subset 232 at the first end 201 and from one sensor subset 241 or 242 at the second end 202.

At a first synchronization point generally indicated by T2 at the beginning of a computing cycle, the controller replica 310A and the controller replica 310B exchange the first set of inputs 311 and the second set of inputs 312 to obtain a set of equalized inputs (not shown). For example, the controller replica 310A sends the first set of inputs 311 to the controller replica 310B, and the controller replica 310B sends the second set of inputs 312 to the controller replica 310A. Each of the controller replica 310A and controller replica 310B is configured to generate, from the first set of inputs 311 and second set of inputs 312, a set of equalized inputs. In an example, the set of equalized inputs corresponds to the averages of the first set of inputs 311 and second set of inputs 312. Other manners for equalization, which is a data exchange between multi computing elements in a predefined synchronization point for ensuring all computing elements at the computer begins the computing cycle with the same identical inputs, are within the scopes of various embodiments. As a result of the equalization, both the controller replica 310A and the controller replica 310B have the same set of inputs, i.e., the set of equalized inputs.

The controller replica 310A and controller replica 310B use the same set of inputs, i.e., the set of equalized inputs, to run the computation for determining controls for the movement of the vehicle, as described herein, until the computation is completed. As a result of the computation, the controller replica 310A and controller replica 310B generate corresponding sets of outputs 313, 314.

At a second synchronization point generally indicated by T3 at the end of the computing cycle, the controller replica 310A and the controller replica 310B exchange their sets of outputs 313, 314. For example, the controller replica 310A sends its set of outputs 313 to the controller replica 310B, and the controller replica 310B sends its set of outputs 314 to the controller replica 310A. This process is also referred to as "cross comparison" which, in one or more embodiments, includes a data exchange between multi computing elements in a predefined synchronization point checking that the outputs of all computing elements at the computer matches at the end of the computing cycle.

When a result of the cross comparison indicates that the controller replica 310A and controller replica 310B have generated the same outputs, or outputs with differences falling within a predefined tolerance, or below a predetermined threshold, it is determined that the sensor subsets that provide sensor data for the computations and the controller replica 310A and controller replica 310B are healthy. The outputs of the controller replica 310A and/or the controller replica 310B are then used to control movement of the vehicle.

However, a failure of the cross comparison of the sets of outputs 313, 314 is indicative of a failure in both the controller replica 310A and the controller replica 310B, due to a random hardware failure or a transient (glitch) as a result of electro-magnetic interference (EMI), and an indicator is generated to notify the vehicle operator or an external control system of the failure.

In some embodiments, the described cross comparison contains another layer of comparison in which the outputs related to one of the sensor subsets is compared against the outputs related to the other sensor subset. For example, outputs obtained from the computation based on sensor data obtained from one of the sensor subsets (213, 232, 241, 242) are compared with outputs obtained from the computation based on sensor data obtained from another one of the sensor subsets (213, 232, 241, 242). In at least one embodiment, these two outputs are not expected to be identical because each sensor subset provided slightly different inputs due time difference between the measurements or other reasons. However, the output generated based on sensor data from one of the sensor subsets is expected to match, within a predefined tolerance, to the output generated based on sensor data from the other sensor subset. Comparison failure in this layer is indicative of a failure in both of the sensor subsets due to a random hardware failure or a transient (glitch) as a result of EMI, and an indicator is generated to notify the vehicle operator or an external control system of the failure.

The described checked redundancy arrangement achieves the SIL 4 requirements in at least one embodiment. In some embodiments, despite the presence of failures in one or more of the controller replicas and/or sensor subsets, safe operations of the vehicle are ensured by the remaining, healthy controller replica(s) and/or sensor subset(s).

Figure 4A:
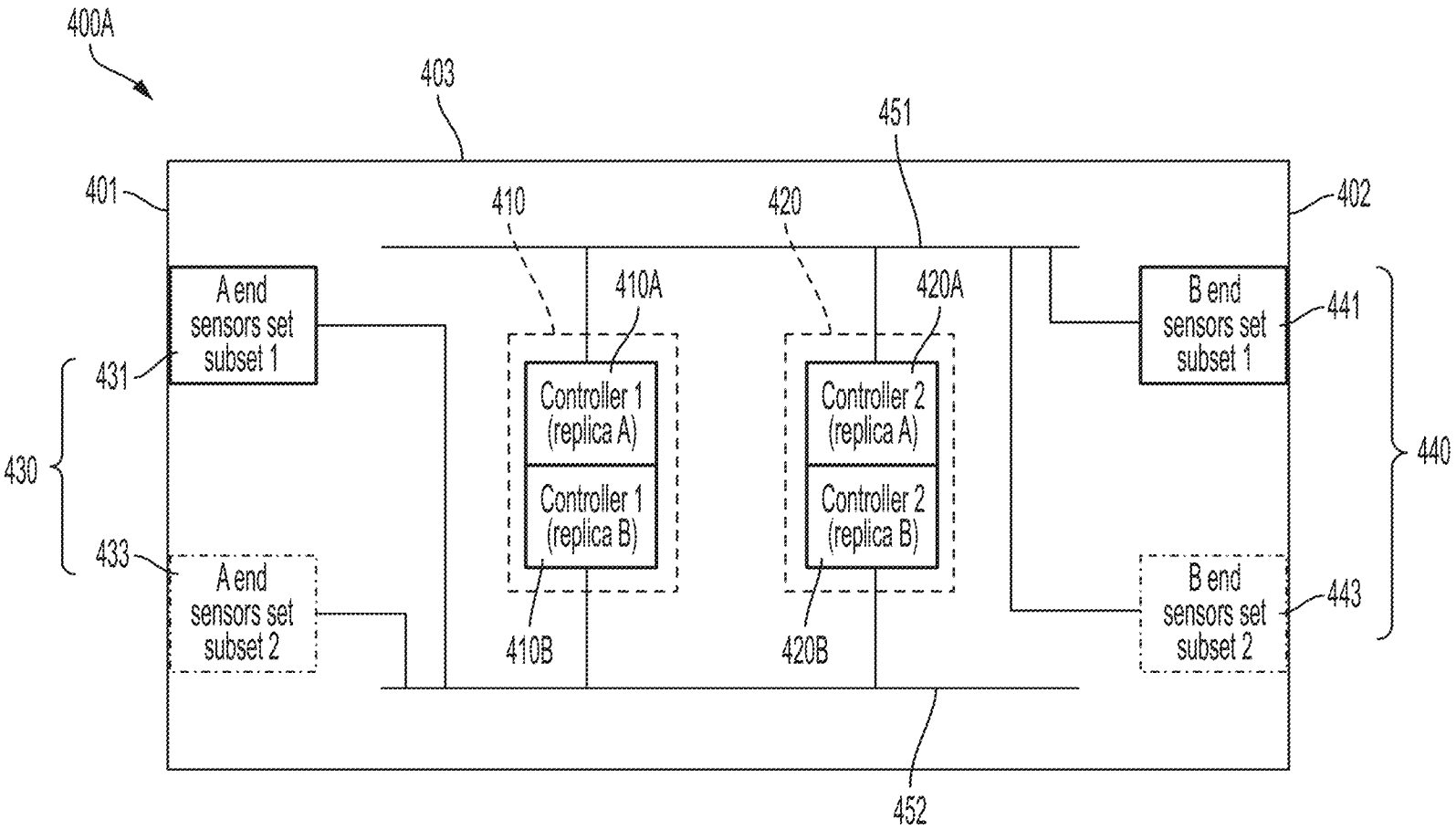
FIGS. 4A-4C are schematic block diagrams of various systems for controlling a vehicle, in accordance with some embodiments.
Figure 4B:
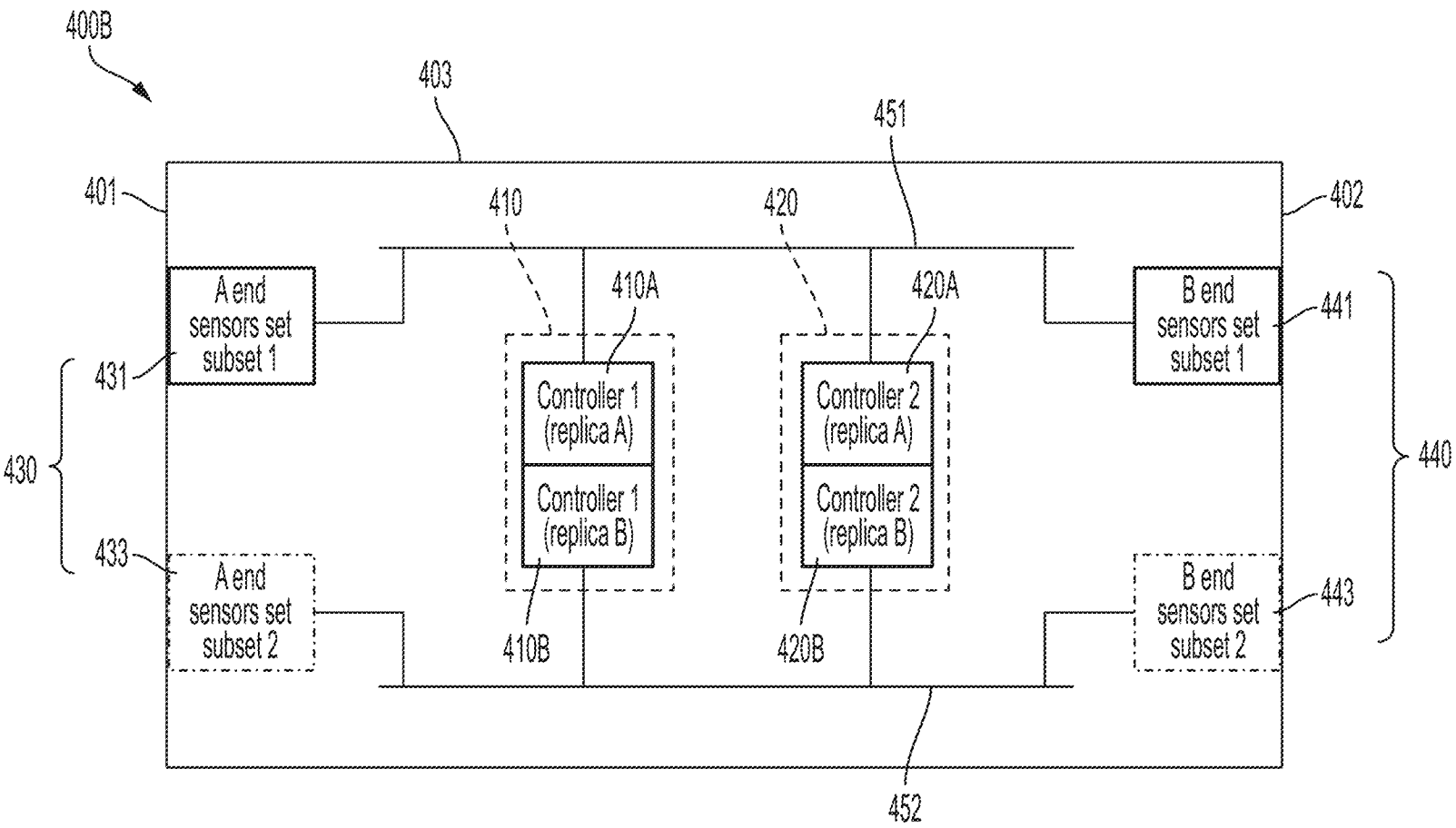
Figure 4C:
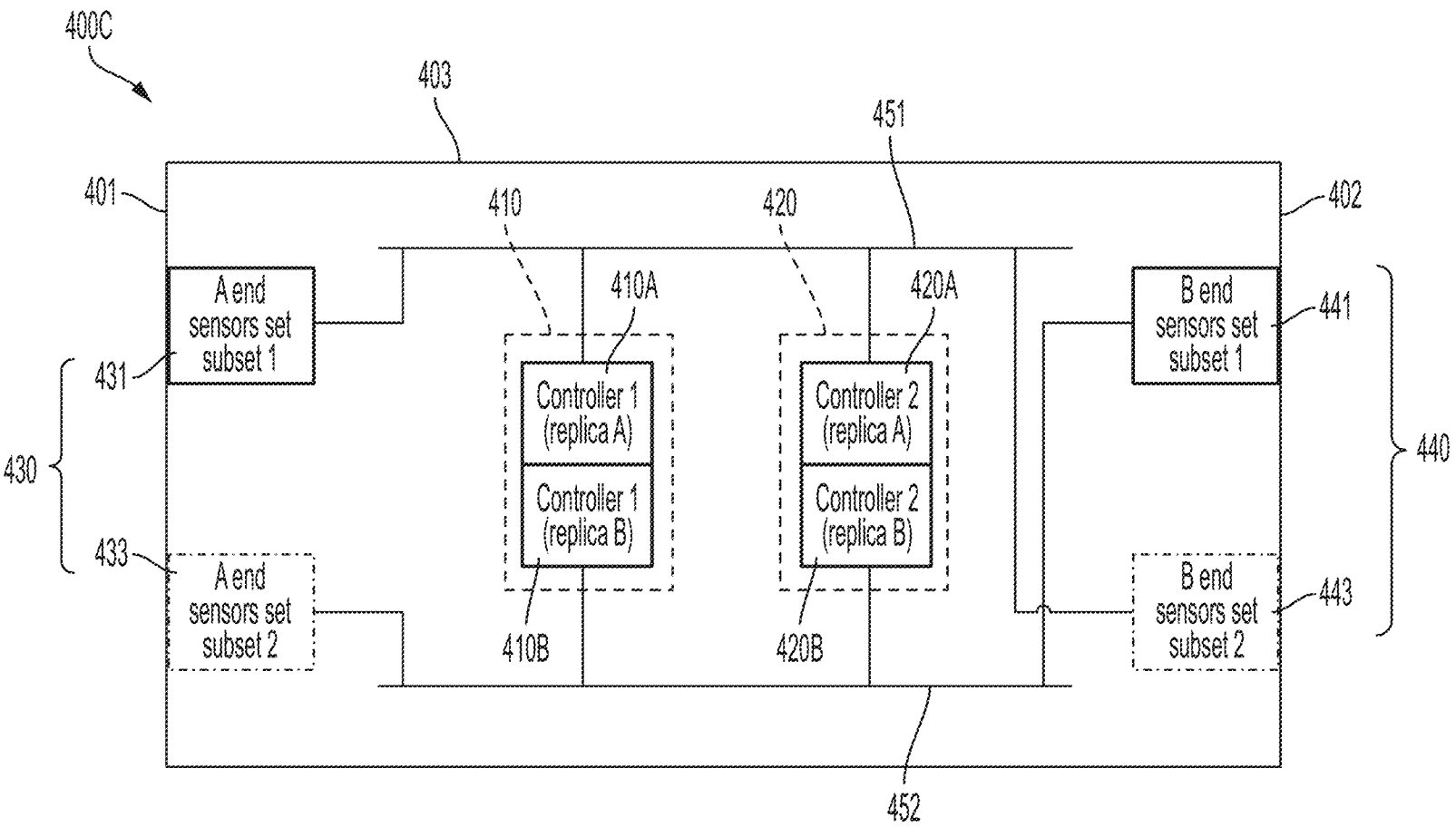

FIGS. 4A-AC are schematic block diagrams of various systems 400A-400C for controlling a vehicle, in accordance with some embodiments. Components in FIGS. 4A-4C having corresponding components in FIGS. 2A-2C are designated by the reference numerals of FIGS. 2A-2C increased by 200. Corresponding components in FIGS. 4A-4C are designated by the same reference numerals.

In FIG. 4A, the system 400A comprises a first controller 410, a second controller 420, a first sensor set 430, a second sensor set 440, and vehicle networks 451, 452 all of which are installed on a vehicle 403 having a first end 401 and a second end 402. In some embodiments, the first controller 410, the second controller 420, the first sensor set 430, the second sensor set 440, the vehicle 403, the first end 401, and the second end 402 correspond to the first controller 110, the second controller 120, the first sensor set 130, the second sensor set 140, the vehicle 103, the first end 101 and the second end 102. The networks 451, 452 correspond to the networks 251, 252. The vehicle 403 further comprises a motoring and braking system (not shown) corresponding to the motoring and braking system 104.

The first controller 410 comprises first and second controller replicas 410A, 410B which are identical to each other. The second controller 420 comprises first and second controller replicas 420A, 420B which are identical to each other. In at least one embodiment, the first controller 410, the controller replicas 410A, 410B, the second controller 420, the controller replicas 420A, 420B correspond to the first controller 210, the controller replicas 210A, 210B, the second controller 220, the controller replicas 220A, 220B.

The first sensor set 430 is installed at the first end 401 of the vehicle 403. Other physical locations of the first sensor set 430 are within the scopes of various embodiments. The first sensor set 430 comprises first and second sensor subsets 431, 433. Both the first and second sensor subsets 431, 433 are coupled to the network 452, and configured to provide sensor data to the controller replica 410B of the first controller 410 and the controller replica 420B of the second controller 420. Each of the first and second sensor subsets 431, 433 includes sensors configured to provide sufficient data for each and any of the first controller 410 and second controller 420 to perform their functions as described herein.

A difference between the system 400A and the system 200A is that while the first and second sensor subsets 231, 232 of the first controller 210 in the system 200A are identical, the first and second sensor subsets 431, 433 of the first sensor set 430 in the system 400A are dissimilar. Specifically, the first sensor subset 431 comprises sensors to detect or measure values of a plurality of parameters, e.g., position, speed, acceleration, and the second sensor subset 433 also comprises sensors to detect or measure values of the same plurality of parameters, e.g., position, speed, acceleration. However, at least a sensor for detecting or measuring values of a parameter in the first sensor subset 431 is different from the corresponding sensor for detecting or measuring values of the same parameter in the second sensor subset 433, in at least one of a sensor type, a frequency band, a sensing technology, or a sensing principle. Examples of different sensor types include, but are not limited to, camera, LiDAR, radar, inertial measurement unit (IMU), inclinimoter, wheel sensor, or the like. Examples of different frequency bands include, but are not limited to, 24 GHz and 77 GHz for radars, or visible spectrum and long wave infrared (IR) for cameras, or the like. Examples of different sensing technologies include, but are not limited to, frequency modulated continuous wave (FMCW) radar, pulse radar, coherent LiDAR, incoherent LiDAR, visible spectrum camera, long wave IR camera, liquid capacitive, magnetic flux, specific force, or the like. Examples of different sensing principles include, but are not limited to, time of flight (TOF), Doppler shift or Doppler speed measurement, imaging, range to target measurement, angular position of the target within the sensor's field of view (FOV) measurement, acceleration measurement, angular speed measurement, magnetic flux measurement, or the like. The same sensor type may involve different sensing technologies. For example, for the same sensor type of radar, different sensing technologies include time of flight, Doppler, continuous wave (CW), and pulse. For the same sensor type of LiDAR, different sensing technologies include coherent LiDAR and incoherent LiDAR. In an example, each of the first sensor subset 431 and the second sensor subset 433 comprises a speed sensor; however, the speed sensor in the first sensor subset 431 is a Doppler radar whereas the speed sensor in the second sensor subset 433 is a wheel sensor. As a result, the first sensor subset 431 and the second sensor subset 433 are considered dissimilar.

The second sensor set 440 is installed at the second end 402 of the vehicle 403. Other physical locations of the second sensor set 440 are within the scopes of various embodiments. the second sensor set 440 comprises first and second sensor subsets 441, 443. Both the first and second sensor subsets 441, 443 are coupled to the network 451, and configured to provide sensor data to the controller replica 410A of the first controller 410 and the controller replica 420A of the second controller 420. Each of the first and second sensor subsets 411, 443 includes sensors configured to provide sufficient data for each and any of the first controller 410 and second controller 420 to perform their functions as described herein. The first and second sensor subsets 441, 443 of the second sensor set 440 are dissimilar in at least one of a sensor type, a frequency band, a sensing technology, or a sensing principle, as described with respect to the first sensor subset 431 and second sensor subset 433.

In some embodiments, the first sensor subset 431 of the first sensor set 430 is identical to one of the first sensor subset 441 and the second sensor subset 443 of the second sensor set 440, whereas the second sensor subset 433 of the first sensor set 430 is identical to the other of the first sensor subset 441 and the second sensor subset 443 of the second sensor set 440.

The operations of the system 400A are similar to the operations of the system 200A. In at least one embodiment, one or more advantages described herein with respect to the system 200A are achievable in the system 400A. In at least one embodiment, SIL 4 is achieved.

Compared to the system 200A, the system 400A further provides sensor diversity/dissimilarity. Sensor diversity/dissimilarity is advantageous, in one or more embodiments, to ensure that the high integrity level (e.g., SIL 4) required for one or more of the odometry, positioning, obstacle avoidance, motion direction, orientation, stationary and cold motion functions is achievable in cases where the sensor failure modes are not fully understood or can be accounted for.

In FIG. 4B, the system 400B is different from the system 400A in the connections of the sensor subsets to the vehicle networks. Specifically, instead of the connections of both the first and second sensor subsets 431, 433 of the first sensor set 430 to the network 452 as in the system 400A, the first and second sensor subsets 431, 433 of the first sensor set 430 in the system 400B are correspondingly coupled to the networks 451, 452. Similarly, instead of the connections of both the first and second sensor subsets 441, 443 of the second sensor set 440 to the network 451 as in the system 400A, the first and second sensor subsets 441, 443 of the second sensor set 440 in the system 400B are correspondingly coupled to the networks 451, 452. In at least one embodiment, one or more advantages described herein with respect to the system 400A are achievable in the system 400B.

In FIG. 4C, the system 400C is different from the system 400B in the connections of the sensor subsets to the vehicle networks. Specifically, instead of the connections of the first and second sensor subsets 441, 443 of the second sensor set 440 in the system 400B correspondingly to the networks 451, 452, the first and second sensor subsets 441, 443 of the second sensor set 440 in the system 400C are correspondingly coupled to the networks 452, 451. In at least one embodiment, one or more advantages described herein with respect to the system 400B are achievable in the system 400C.

Compared to the system 400A, the system 400B or system 400C provides spatial diversity to the sensor set arrangement, as described with respect to the system 200B or the system 200C. In some embodiments where a control system for a vehicle is configured to optimally operate with one sensor subset at the A end of the vehicle and another sensor subset at the B end of the vehicle to achieve spatial diversity, the system 400B or system 400C is preferred. In some embodiments where a control system for a vehicle is configured to optimally operate with two sensor subsets at the same end of the vehicle, the system 400A is preferred.

Figure 5A:
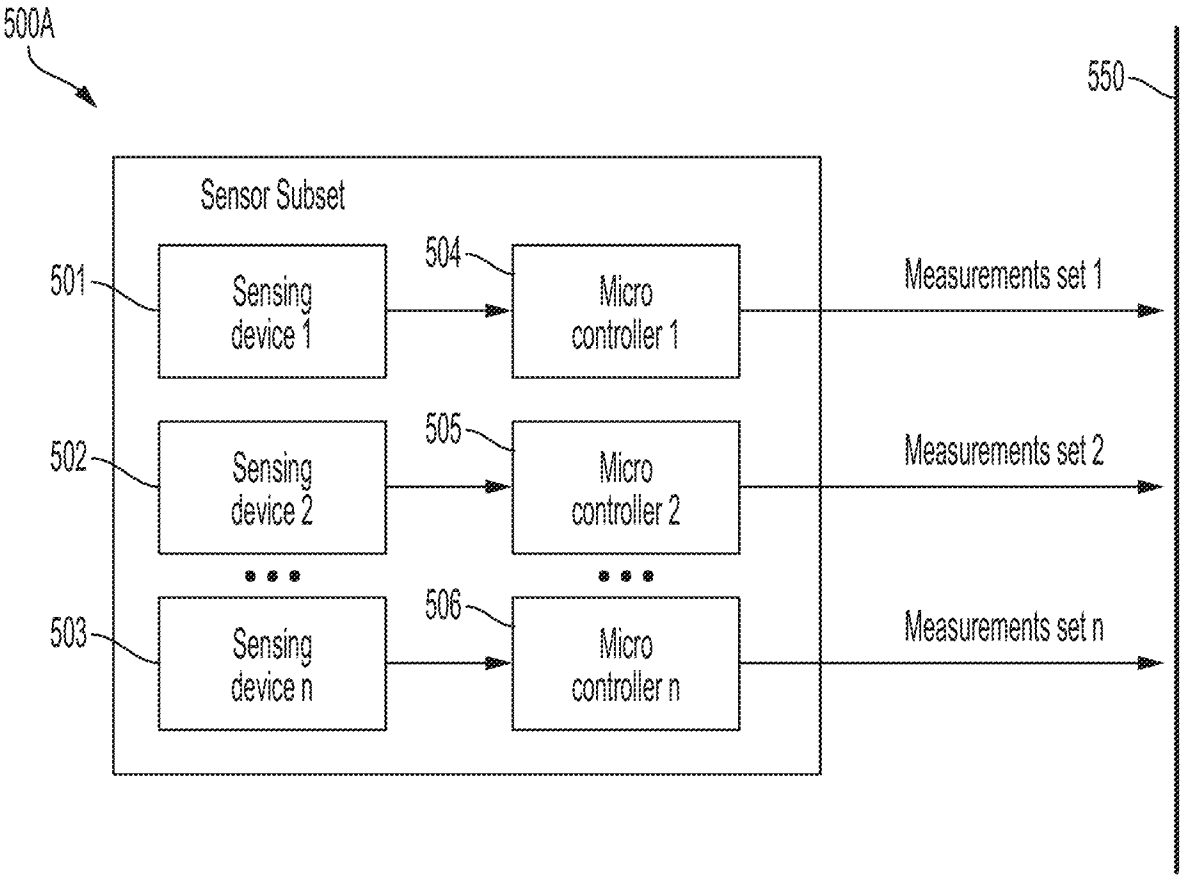
FIGS. 5A-5B are schematic block diagrams of various sensor subset configurations in a system for controlling a vehicle, in accordance with some embodiments.

FIG. 5A is a schematic block diagram of a sensor subset 500A in a system for controlling a vehicle, in accordance with some embodiments. In at least one embodiment, the sensor subset 500A corresponds to one or more of the first sensor set 130 and the second sensor set 140 described with respect to FIG. 1, and/or one or more of the sensor subsets described with respect to one or more of FIGS. 2A-2C, 4A-4C.

The sensor subset 500A comprises a plurality of sensors 501, 502, 503 and a plurality of micro-controllers 504, 505, 506 each having an input coupled to a corresponding sensor without being coupled to the other sensors. For example, an input of the micro-controller 504 is coupled to the sensor 501, without being coupled to the other sensors 502, 503. An input of the micro-controller 505 is coupled to the sensor 502, without being coupled to the other sensors 501, 503. An input of the micro-controller 506 is coupled to the sensor 503, without being coupled to the other sensors 501, 502. The micro-controllers 504, 505, 506 further include outputs coupled to a network 550. In at least one embodiment, the network 550 corresponds to one or more of the networks 150, 251, 252, 451, 452 described with respect to one or more of FIGS. 1, 2A-2C, 4A-4C. The sensors 501, 502, 503 are indicated in the drawings as "Sensing device 1," "Sensing device 2," "Sensing device 3." The micro-controllers 504, 505, 506 are indicated in the drawings as "Microcontroller 1," "Microcontroller 2," "Microcontroller 3." The described sensor subset arrangement with three sensors and three corresponding micro-controllers is an example. Other sensor subset configurations with different numbers of sensors or micro-controllers are within the scopes of various embodiments.

The sensors 501, 502, 503 are configured to detect or measure values of a plurality of parameters to provide sufficient data for each and any controller or controller replica to perform various functions for controlling movement of a vehicle, as described herein.

The micro-controllers 504, 505, 506 are configured to process the detected or measured values output by the corresponding sensors 501, 502, 503, and output the corresponding processed sensor data or measurement sets to the network 550. In some embodiments, a micro-controller is an integrated circuit configured to perform a specific operation in an embedded system. In at least one embodiment, a micro-controller includes a processor (CPU), a memory and input/output (I/O) peripherals on a single chip.

In some embodiments, the micro-controllers 504, 505, 506 are provided where data output from the corresponding sensors 501, 502, 503 are in a format that is not ready for processing by a controller or controller replica. For example, when the sensor 501 is a wheel sensor, data output from the wheel sensor may not directly represent a speed of the vehicle. The corresponding micro-controller 504 is coupled to the sensor 501 to process the data output from the wheel sensor and convert the processed data into a value of the speed of the vehicle for use by one or more controller or controller replica in the control system, as described herein. In some embodiments, when the data output from one or more of the sensors 501, 502, 503 are in a format that is ready for processing by a controller or controller replica, the corresponding one or more micro-controllers 504, 505, 506 is/are omitted.

Figure 5B:
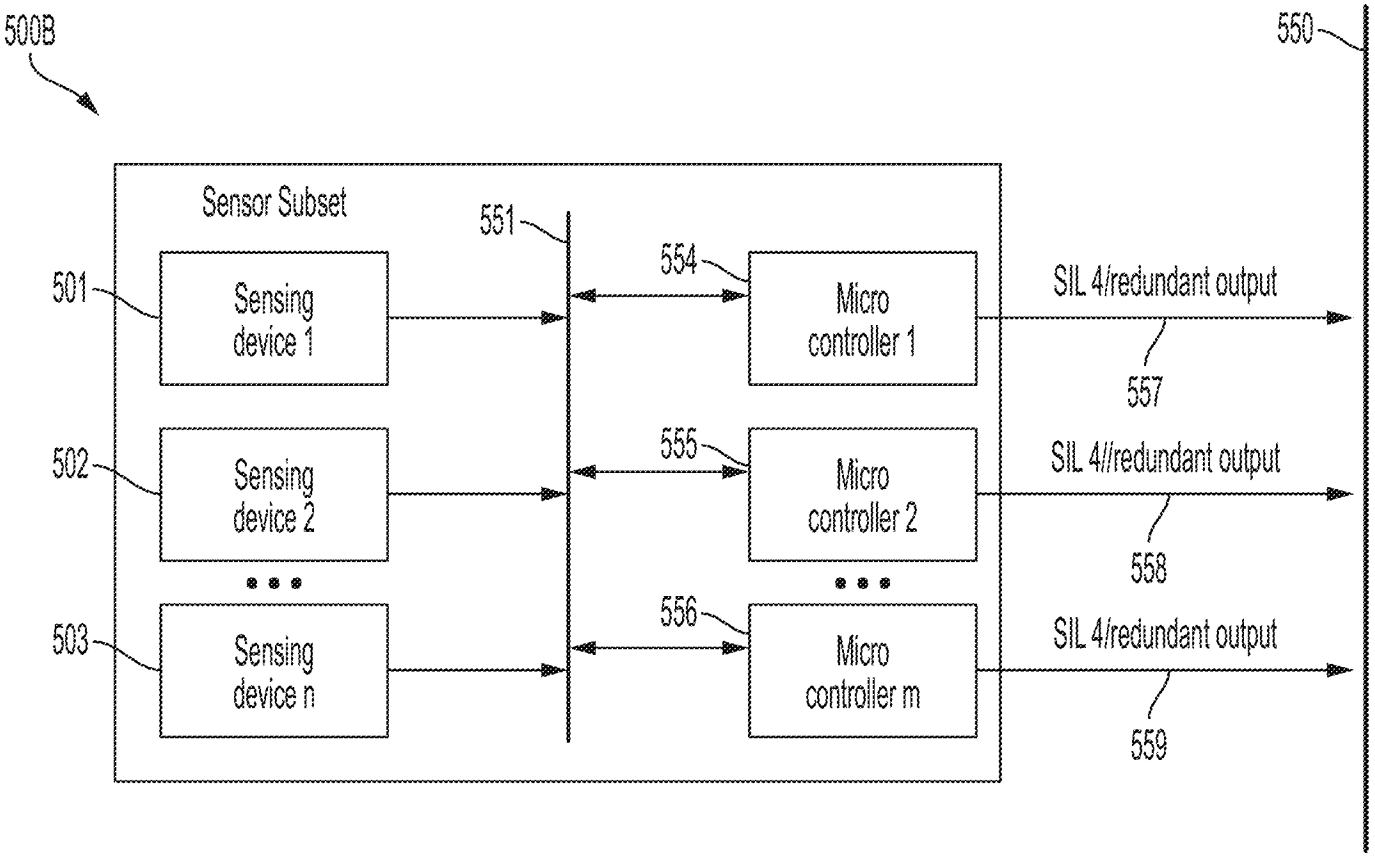

FIG. 5B is a schematic block diagram of a sensor subset 500B in a system for controlling a vehicle, in accordance with some embodiments. In at least one embodiment, the sensor subset 500B corresponds to one or more of the first sensor set 130 and the second sensor set 140 described with respect to FIG. 1, and/or one or more of the sensor subsets described with respect to one or more of FIGS. 2A-2C, 4A-4C. Corresponding components in FIGS. 5A-5B are designated by the same reference numerals.

The sensor subset 500B comprises a plurality of sensors 501, 502, 503 coupled to a bus 551. For example, the sensor subset 500B comprises n sensors, where n is a natural number greater than 1. The sensor subset 500B comprises a plurality of micro-controllers 554, 555, 556 coupled to a bus 551 to communicate with the sensors 501, 502, 503. For example, the sensor subset 500B comprises m micro-controllers 554, 555, 556, where m is a natural number greater than 1. In some embodiments, the number n of the sensors 501, 502, 503 is different from the number m of the micro-controllers 554, 555, 556. In at least one embodiment, n is equal to m.

In some embodiments, each of the micro-controllers 554, 555, 556 is communicated with, or has access to, multiple, or all, of the sensors 501, 502, 503 via the bus 551. Each of the micro-controllers 554, 555, 556 is configured to cross check measurements of the multiple, or all, sensors 501, 502, 503 it is communicated with to verify one or more of correctness, consistency and plausibility of the measurements. As result, each of the micro-controllers 554, 555, 556 is configured to generate a corresponding high level of integrity (e.g., SIL 4) output 557, 558, 559 (such as speed, range, etc.) which are applied to the network 550 for use by a controller or controller replica in the system for controlling a vehicle. In some embodiments, further cross check between multiple or all outputs 557, 558, 559 from the micro-controllers 554, 555, 556 is performed at a higher level in the system, e.g., at a controller or controller replica that receives the 557, 558, 559 from the network 550. In at least one embodiment, one or more of the micro-controllers 554, 555, 556 is/are further configured to process measured values of one or more of the sensors 501, 502, 503 and convert the processed values into a format ready for processing by a controller or controller replica, as described herein. In at least one embodiment, one or more advantages described herein are achievable in a system for controlling a vehicle that uses one or more of the sensor subset 500A and/or sensor subset 500B.

Figure 6:
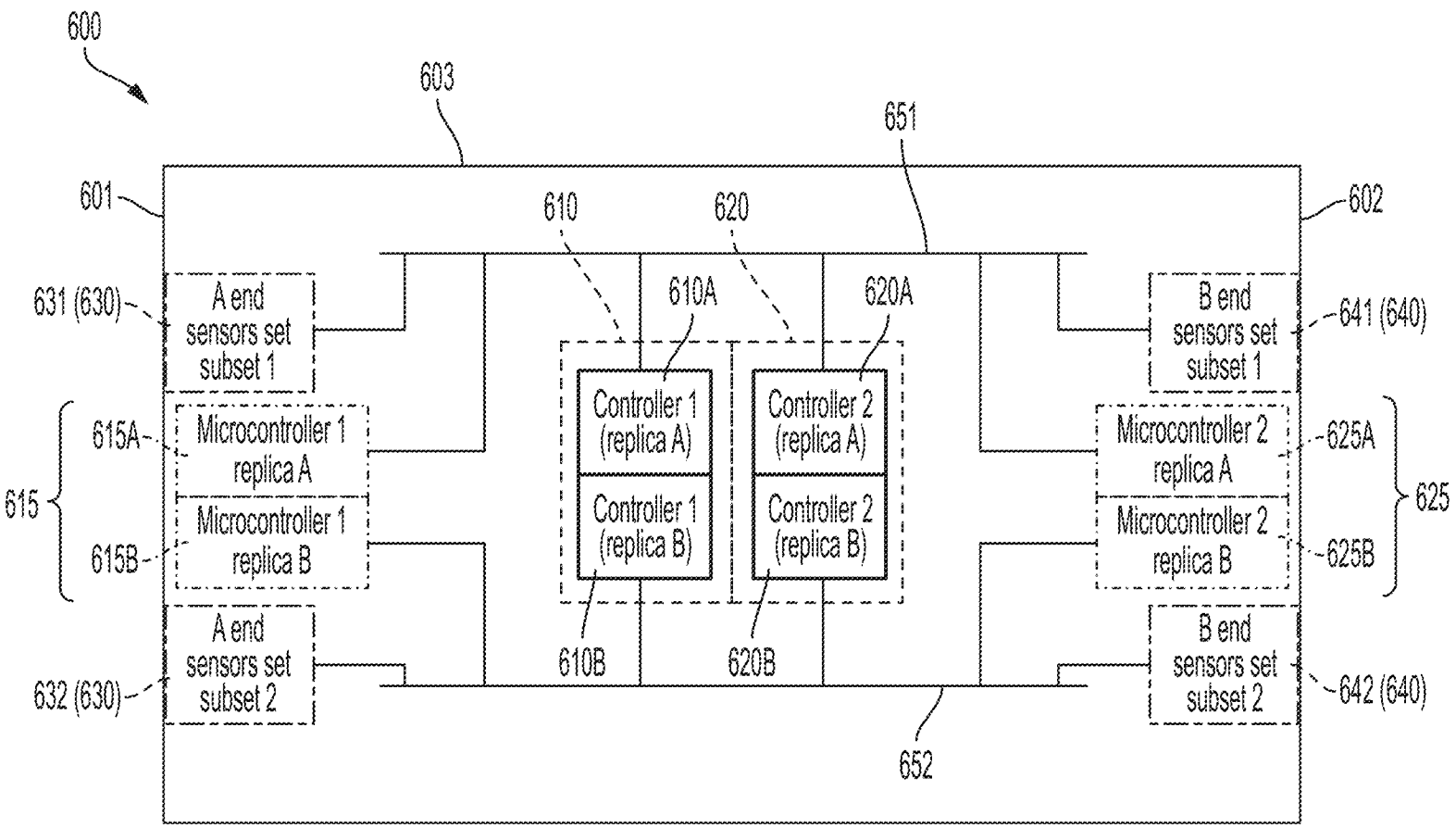
FIG. 6 is a schematic block diagram of a system for controlling a vehicle, in accordance with some embodiments.

FIG. 6 is a schematic block diagram of a system 600 for controlling a vehicle, in accordance with some embodiments. Components in FIG. 6 having corresponding components in FIGS. 2A-2C are designated by the reference numerals of FIGS. 2A-2C increased by 400. Components in FIG. 6 having corresponding components in FIGS. 4A-4C are designated by the reference numerals of FIGS. 4A-4C increased by 200.

In FIG. 6, the system 600 comprises a first controller 610, a second controller 620, a first sensor set 630, a second sensor set 640, and vehicle networks 651, 652 all of which are installed on a vehicle 603 having a first end 601 and a second end 602. In some embodiments, the first controller 610, the second controller 620, the first sensor set 630, the second sensor set 640, the vehicle 603, the first end 601, and the second end 602 correspond to the first controller 110, the second controller 120, the first sensor set 130, the second sensor set 140, the vehicle 103, the first end 101 and the second end 102. The networks 651, 652 correspond to the network 150, or the networks 251, 252, or the networks 451, 452. The vehicle 603 further comprises a motoring and braking system (not shown) corresponding to the motoring and braking system 104.

The first controller 610 comprises first and second controller replicas 610A, 610B which are identical to each other. The second controller 620 comprises first and second controller replicas 620A, 620B which are identical to each other. In at least one embodiment, the first controller 610, the controller replicas 610A, 610B, the second controller 620, the controller replicas 620A, 620B correspond to the first controller 410, the controller replicas 410A, 410B, the second controller 420, the controller replicas 420A, 420B, or correspond to the first controller 210, the controller replicas 210A, 210B, the second controller 220, the controller replicas 220A, 220B.

The first sensor set 630 is installed at the first end 601 of the vehicle 603. Other physical locations of the first sensor set 630 are within the scopes of various embodiments. The first sensor set 630 comprises first and second sensor subsets 631, 632. The second sensor set 640 is installed at the second end 602 of the vehicle 603. Other physical locations of the second sensor set 640 are within the scopes of various embodiments. The second sensor set 640 comprises first and second sensor subsets 641, 642.

In at least one embodiment, the first and second sensor subsets 631, 632 of the first sensor set 630 are identical to each other, and/or the first and second sensor subsets 641, 642 of the second sensor set 640 are identical to each other. In some embodiments, the first and second sensor subsets 631, 632 of the first sensor set 630 are dissimilar as described with respect to the sensor subsets 431, 433, and/or the first and second sensor subsets 641, 642 of the second sensor set 640 are dissimilar as described with respect to the sensor subsets 431, 433.

The system 600 further comprises a first micro-controller 615 and a second micro-controller 625. The first micro-controller 615 comprises first and second micro-controller replicas 615A, 615B which are identical to each other. The micro-controller replicas 615A, 615B of the first micro-controller 615 are correspondingly indicated in the drawings as "Microcontroller 1 replica A" and "Microcontroller 1 replica B." Each of the micro-controller replicas 615A, 615B is configured to perform all functions of the first controller 610, and/or the controller replicas 610A, 610B. Example functions of are described with respect to the first controller 110, and include, but are not limited to, odometry, positioning, obstacle avoidance, motion direction, orientation, stationary and cold motion functions, as well as computation based on sensor data from any of the first sensor set 630 and the second sensor set 640 to control the motoring and braking system of the vehicle 603. In one or more embodiments, a power supply of the micro-controller replica 615A is separate and isolated from a power supply of the micro-controller replica 615B. The micro-controller replica 615A is coupled to the network 651, and the micro-controller replica 615B is coupled to the network 652. In some embodiments, the networks 651, 652 are separated and isolated from each other. As a result, in at least one embodiment, the micro-controller replicas 615A, 615B are separated and isolated from each other in terms of both power supply and communication. In other words, the micro-controller replicas 615A, 615B are physically independent from each other.

Although the micro-controller replicas 615A, 615B are configured to perform at least the same functions as the controller replicas 610A, 610B, the micro-controller replicas 615A, 615B are dissimilar from the controller replicas 610A, 610B, in at least one of a processor, a memory or an instruction set. In some embodiments, the micro-controller replicas 615A, 615B are configured to execute algorithms different from those of the controller replicas 610A, 610B to perform, based on the sensor data, computation for controlling the movement of the vehicle. Typically, the processing unit of a micro-controller (or micro-controller replica) is dissimilar to the processing unit (e.g., a processor) of a controller (or controller replica). In some situations, each processing unit may have defects (errata) and, therefore, running the functions on dissimilar processing units helps to reduce the influence of such errata on the functions integrity level. In some embodiments, the algorithms for the same functions in the controller (or controller replica) and in the micro-controller (or micro-controller replica) are implemented with diversity which will help reducing the influence of human errors (e.g., bugs) and/or common cause errors on the functions integrity level.

In at least one embodiment, the micro-controller replicas 615A, 615B are further configured to perform additional functions, such as algorithms to supervise other algorithms executed within the controller replicas 610A, 610B to achieve the high level of integrity (e.g., SIL 4) expected from the odometry, positioning, obstacle avoidance, motion direction, orientation, stationary and cold motion functions. For example, a sensor fusion algorithm for positioning is a complex algorithm which requires heavy processing capacity. Such a complex algorithm is executed by a controller replica. A micro-controller replica is configured to execute, as a protection level, a simpler algorithm but with a high level of integrity, to supervise the complex algorithm executed by the controller replica.

The second micro-controller 625 comprises first and second micro-controller replicas 625A, 625B which are identical to each other. The micro-controller replicas 625A, 625B of the first micro-controller 625 are correspondingly indicated in the drawings as "Microcontroller 2 replica A" and "Microcontroller 2 replica B." Each of the micro-controller replicas 625A, 625B is configured to perform all functions of the first controller 620, and/or the controller replicas 620A, 620B. In one or more embodiments, the micro-controller replicas 625A, 625B are separated and isolated from each other in terms of both power supply and communication. In other words, the micro-controller replicas 625A, 625B are physically independent from each other. The micro-controller replicas 625A, 625B are dissimilar from the controller replicas 620A, 620B, in at least one of a processor, a memory or an instruction set. In some embodiments, the micro-controller replicas 625A, 625B are configured to execute algorithms different from those of the controller replicas 620A, 620B to perform, based on the sensor data, computation for controlling the movement of the vehicle. In at least one embodiment, the micro-controller replicas 625A, 625B are further configured to perform additional functions, such as algorithms to supervise other algorithms executed within the controller replicas 620A, 620B to achieve the high level of integrity (e.g., SIL 4) expected from the odometry, positioning, obstacle avoidance, motion direction, orientation, stationary and cold motion functions.

In at least one embodiment, one or more advantages described herein are achievable in the system 600. The provision of multiple micro-controller replicas 615A, 615B, 625A, 625B for redundancy purposes in the system 600 further improve the safety integrity level in one or more embodiments.

Figure 7:
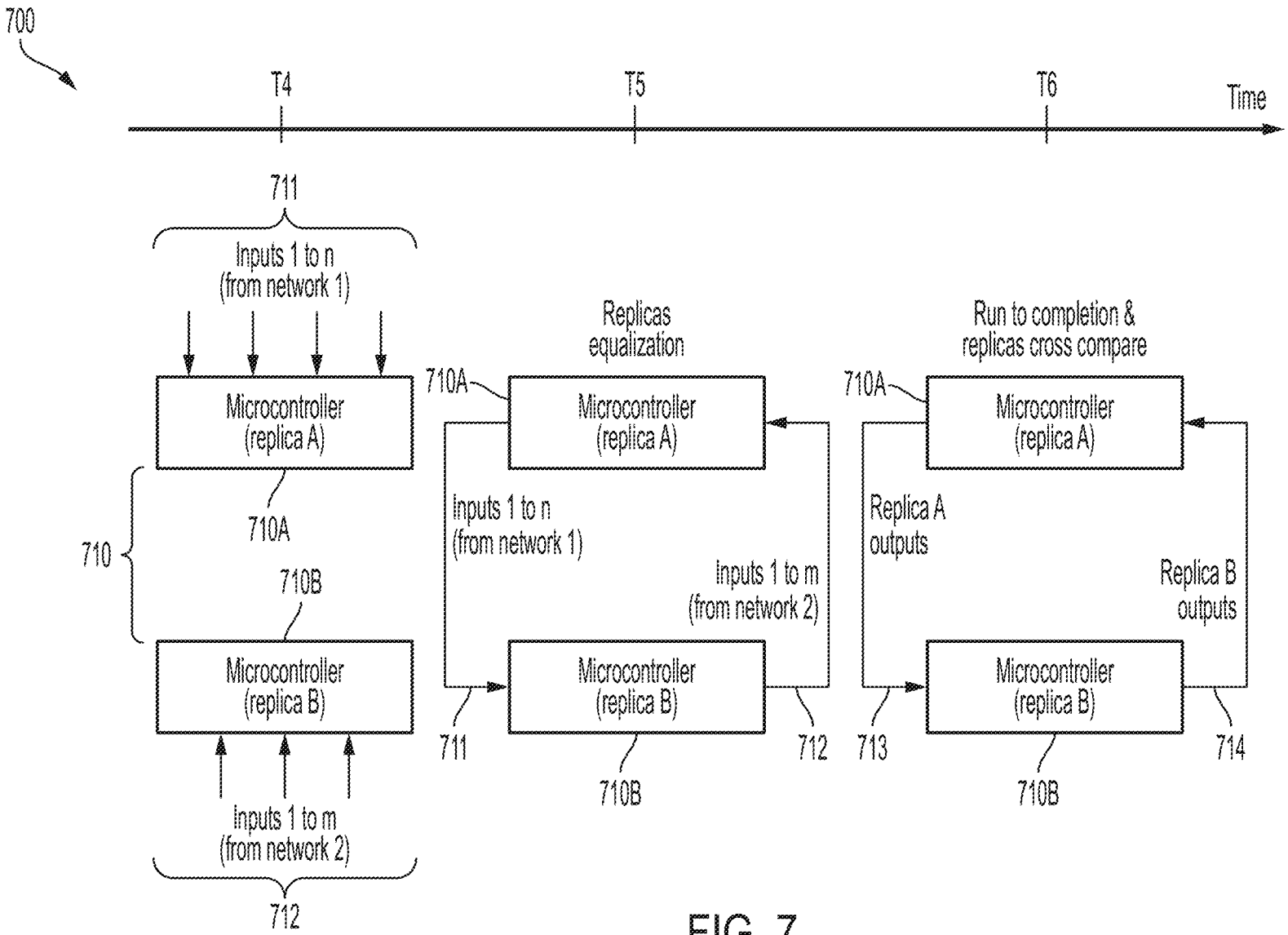
FIG. 7 is a schematic diagram of operations of a microcontroller in a system for controlling a vehicle, in accordance with some embodiments.

FIG. 7 is a schematic diagram of operations of a micro-controller 700 in a system for controlling a vehicle, in accordance with some embodiments. In some embodiments, the micro-controller 700 corresponds to one or more of the first micro-controller 615 and the second micro-controller 625 in the system 600.

The micro-controller 700 comprises first and second micro-controller replicas 710A, 710B which are identical to each other. The first and second micro-controller replicas 710A, 710B are correspondingly indicated in the drawings as "Microcontroller (replica A)" and "Microcontroller (replica B)." In at least one embodiment, the micro-controller replica 710A corresponds to one or more of the micro-controller replicas 615A, 625A, and the micro-controller replica 710B corresponds to one or more the micro-controller replicas 615B, 625B. The micro-controller replica 710A is coupled to a first network corresponding to, e.g., the network 651. The micro-controller replica 710B is coupled to a second network corresponds to, e.g., the network 652.

During operation of the micro-controller 700, at a timing generally indicated by T4, the micro-controller replica 710A receives, a first set of inputs 711, e.g., inputs 1 to n, from the first network. In an example, the first set of inputs 711 includes sensor data from one end of the vehicle. In a further example, the first set of inputs 711 includes sensor data from both ends of the vehicle. At or about the same timing T1 or a different timing, the controller replica 720A receives, a second set of inputs 712, e.g., inputs 1 to m, from the second network. In an example, the second set of inputs 712 includes sensor data from one end of the vehicle. In a further example, the second set of inputs 712 includes sensor data from both ends of the vehicle.

At a first synchronization point generally indicated by T5 at the beginning of a computing cycle, input equalization is performed by the micro-controller replica 710A and the micro-controller replica 710B to exchange the first set of inputs 711 and the second set of inputs 712 for obtaining a set of equalized inputs (not shown). As a result of the equalization, both the micro-controller replica 710A and the micro-controller replica 710B have the same set of inputs, i.e., the set of equalized inputs.

The micro-controller replica 710A and micro-controller replica 710B use the same set of inputs, i.e., the set of equalized inputs, to run the computation for determining controls for the movement of the vehicle, as described herein, until the computation is completed. As a result of the computation, the micro-controller replica 710A and micro-controller replica 710B generate corresponding sets of outputs 713, 714.

At a second synchronization point generally indicated by T6 at the end of the computing cycle, cross comparison is performed by the micro-controller replica 710A and the micro-controller replica 710B to exchange their sets of outputs 713, 714. When a result of the cross comparison indicates that the micro-controller replica 710A and micro-controller replica 710B have generated the same outputs, or outputs with differences falling within a predefined tolerance, or below a predetermined threshold, it is determined that the sensor subsets that provide sensor data for the computations and the micro-controller replica 710A and micro-controller replica 710B are healthy. The outputs of the micro-controller replica 710A and/or the micro-controller replica 710B are then used to control movement of the vehicle. However, a failure of the cross comparison of the sets of outputs 713, 714 is indicative of a failure in at least one of the micro-controller replica 710A or the micro-controller replica 710B, due to a random hardware failure or a transient (glitch) as a result of electro-magnetic interference (EMI), and an indicator is generated to notify the vehicle operator or an external control system of the failure, as described with respect to FIG. 3.

In some embodiments, the described cross comparison contains another layer of comparison in which the outputs related to one of the sensor subsets is compared against the outputs related to the other sensor subset. In at least one embodiment, these two outputs are not expected to be identical because each sensor subset provided slightly different inputs due time difference between the measurements or other reasons. However, the output generated based on sensor data from one of the sensor subsets is expected to match, within a predefined tolerance, to the output generated based on sensor data from the other sensor subset. Comparison failure in this layer is indicative of a failure in at least one of the sensor subsets due to a random hardware failure or a transient (glitch) as a result of EMI, and an indicator is generated to notify the vehicle operator or an external control system of the failure, as described with respect to FIG. 3.

The described checked redundancy arrangement achieves the SIL 4 requirements in at least one embodiment. In some embodiments, despite the presence of failures in one or more of the micro-controller replicas, controller replicas and/or sensor subsets, safe operations of the vehicle are ensured by the remaining, healthy micro-controller replica(s), controller replica(s) and/or sensor subset(s).

Figure 8:
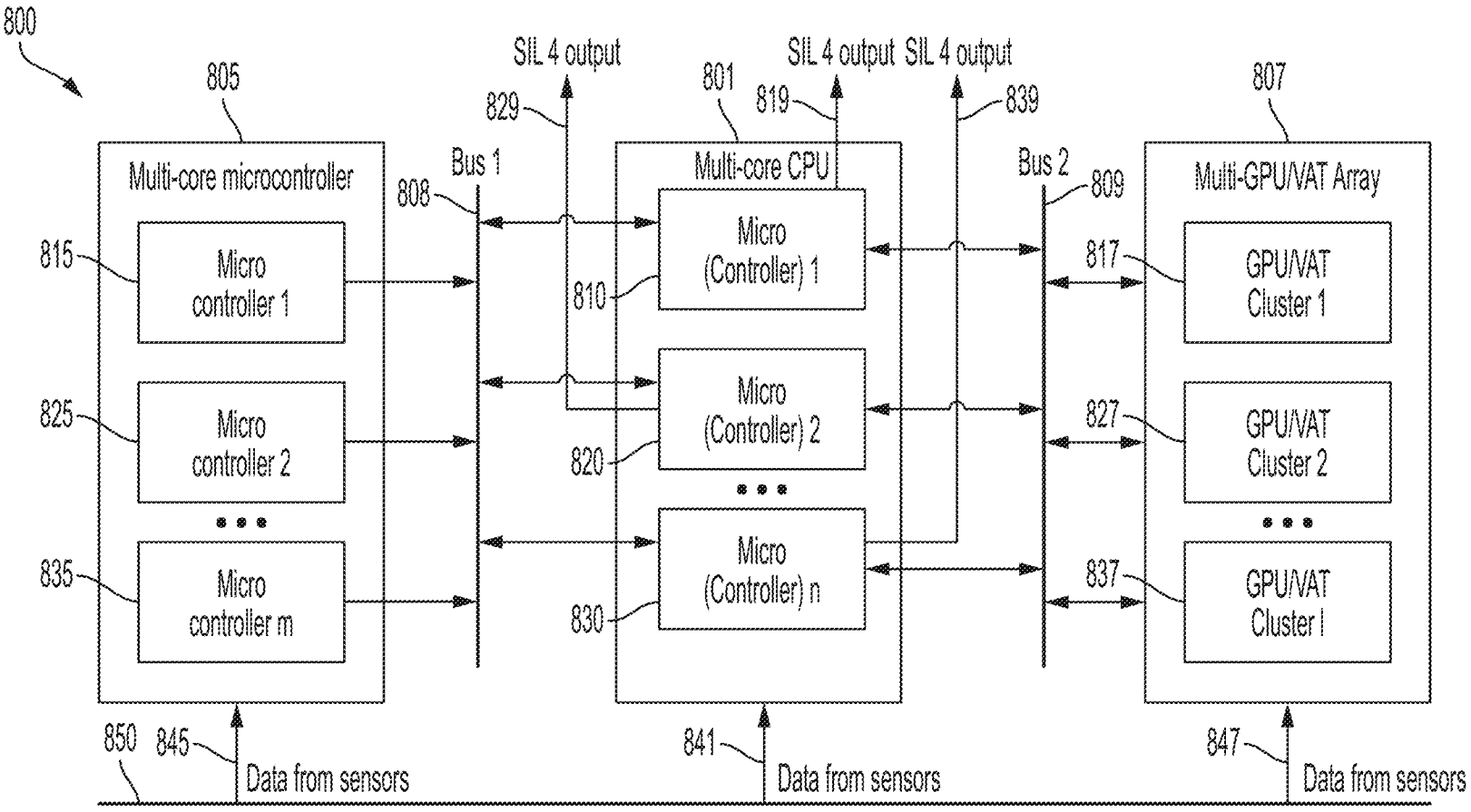
FIG. 8 is a schematic block diagram of a controller replica structure in a system for controlling a vehicle, in accordance with some embodiments.

FIG. 8 is a schematic block diagram of a controller replica structure 800 in a system for controlling a vehicle, in accordance with some embodiments.

The controller replica 800 comprises at least one processor (or CPU) 801, at least one micro-controller 805, and at least one GPU/VAT cluster 807. In some embodiments, the at least one micro-controller 805 and/or the at least one GPU/VAT cluster 807 is/are omitted. In the example configuration in FIG. 8, the at least one processor 801 comprises n processors or CPUs 810, 820, 830, the micro-controller 805 comprises m micro-controllers 815, 825, 835, and the at least one GPU/VAT cluster 807 comprises/GPU/VAT clusters 817, 827, 837, where n, m are 1 are natural numbers.

The controller replica 800 comprises a first bus 808 via which each of the CPUs 810, 820, 830 is communicated with one or more or all of the micro-controllers 815, 825, 835, and/or each of the micro-controllers 815, 825, 835 is communicated with one or more or all of the CPUs 810, 820, 830. The controller replica 800 comprises a second bus 809 via which each of the CPUs 810, 820, 830 is communicated with one or more or all of the GPU/VAT clusters 817, 827, 837, and/or each of the GPU/VAT clusters 817, 827, 837 is communicated with one or more or all of the CPUs 810, 820, 830. Each of the CPUs 810, 820, 830, and/or each of the micro-controllers 815, 825, 835 and/or each of the GPU/VAT clusters 817, 827, 837 is coupled to a network 850 to receive corresponding sensor data 841, 845, 847 from multiple sensor subsets. In at least one embodiment, the network 850 corresponds to one or more of the networks described with respect to FIGS. 1-7.

In some embodiments, one or more of the controllers 110, 120 described with respect to FIG. 1, and/or one or more of the controller replicas described with respect to FIGS. 2A-2C, 3, 4A-4C, 6 is/are configured by one or more of the CPUs 810, 820, 830.

In some embodiments, one or more of the micro-controller replicas described with respect to FIGS. 6, 7 is/are configured to by one or more of the micro-controllers 815, 825, 835. In at least one embodiment, the micro-controllers 815, 825, 835 are omitted.

In some embodiments, one or more of the GPU/VAT clusters 817, 827, 837 is configured to perform image processing/recognition and/or machine learning for processing captured data for the computation of commands for controlling the movement of the vehicle. Image processing/recognition is involved in some embodiments in which the vehicle travelling along a guideway captures image data from markers, such as signs, arranged along the guideway, decodes the captured image data, and uses the decoded image data to control the travel of the vehicle. Various factors may affect how the image data are captured which eventually may affect accuracy and/or integrity of the decoded image data. To ensure that the captured image data are correctly recognized and decoded, one or more of the GPU/VAT clusters 817, 827, 837 is/are installed on the vehicle for image recognition and/or for performing machine learning to improve image recognition and decoding. One or more examples of image recognition/decoding in conjunction with machine learning are described in the U.S. patent application Ser. No. 16/430,194, filed Jun. 3, 2019, titled "SYSTEM FOR AND METHOD OF DATA ENCODING AND/OR DECODING USING NEURAL NETWORKS", which is incorporated by reference herein in its entirety. In at least one embodiment, the GPU/VAT clusters 817, 827, 837 are omitted.

In some embodiments, by using one or more of the CPUs 810, 820, 830, and/or the micro-controllers 815, 825, 835 and/or the GPU/VAT clusters 817, 827, 837, it is possible to achieve the high level of safety integrity (e.g., SIL 4) with certain functions (e.g., image processing and/or neural networks) executed on the GPU/VAT clusters 817, 827, 837 with support of the CPUs 810, 820, 830 and supervision of the microcontroller 815, 825, 835. As a result, it is possible to provide outputs 819, 829, 839 with the high level of integrity (e.g., SIL 4) to the motoring and braking system of the vehicle to ensure safe autonomous operations of the vehicle. In at least one embodiment, one or more advantages described herein are achievable in a system using one or more of the controller replica structures 800 for controlling a vehicle.

Figure 9:
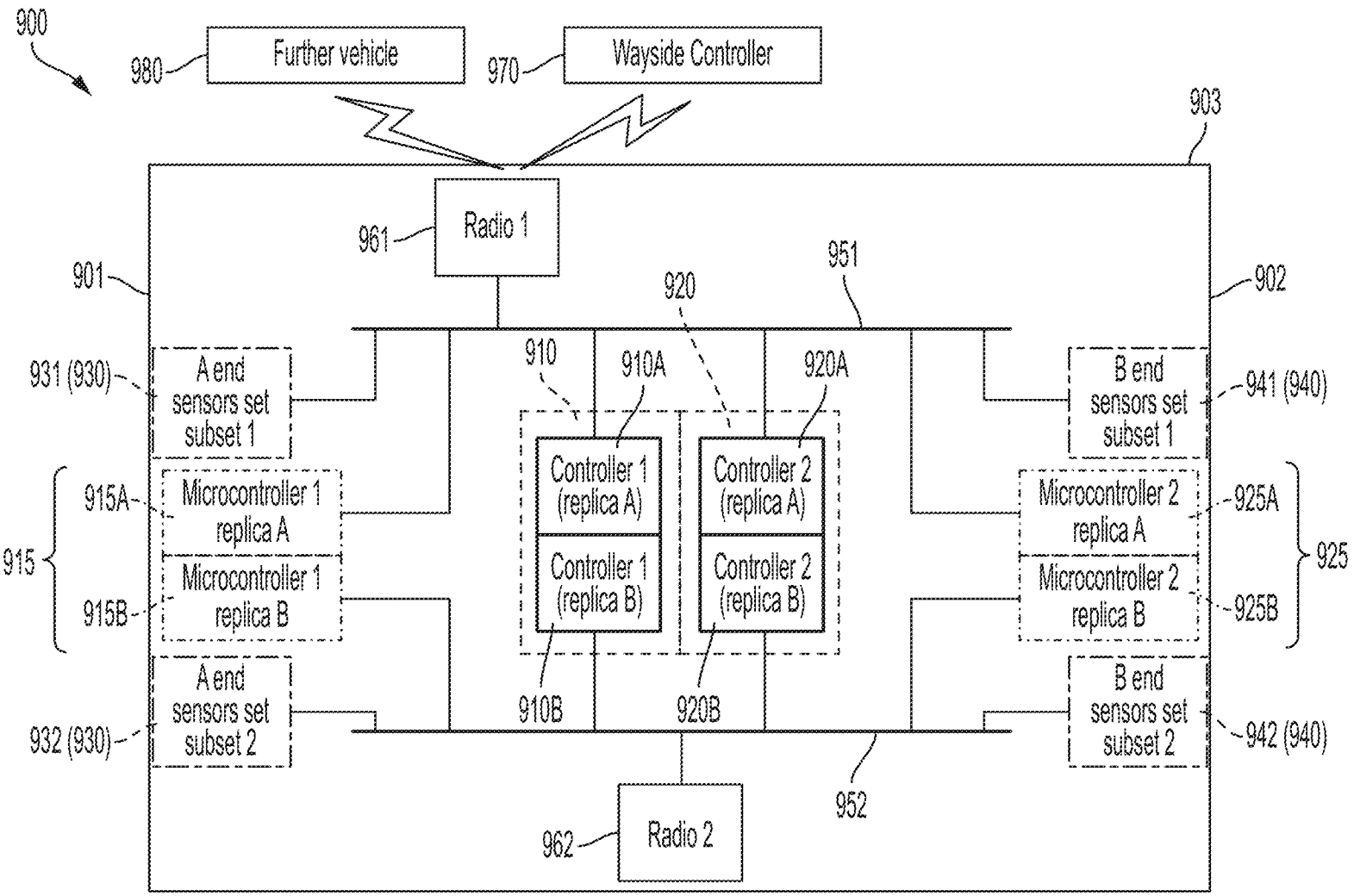
FIG. 9 is a schematic block diagram of a system for controlling a vehicle, in accordance with some embodiments.

FIG. 9 is a schematic block diagram of a system 900 for controlling a vehicle, in accordance with some embodiments. Components in FIG. 9 having corresponding components in FIG. 6 are designated by the reference numerals of FIG. 6 increased by 300.

In FIG. 9, the system 900 comprises a first controller 910 including controller replicas 910A, 910B, a second controller 920 including controller replicas 920A, 920B, a first sensor set 930 including sensor subsets 931, 932, a second sensor set 940 including sensor subsets 941, 942, vehicle networks 951, 952, a first micro-controller 915 including micro-controller replicas 915A, 915B, and a second micro-controller 925 including micro-controller replicas 925A, 925B, all of which are installed on a vehicle 903 having a first end 901 and a second end 902. In some embodiments, the first controller 910, the controller replicas 910A, 910B, the second controller 920, the controller replicas 920A, 920B, the first sensor set 930, the sensor subsets 931, 932, the second sensor set 940, the sensor subsets 941, 942, the vehicle networks 951, 952, the first micro-controller 915, the micro-controller replicas 915A, 915B, the second micro-controller 925, the micro-controller replicas 925A, 925B, the vehicle 903, the first end 901 and the second end 902 correspond to the first controller 610, the controller replicas 610A, 610B, the second controller 620, the controller replicas 620A, 620B, the first sensor set 630, the sensor subsets 631, 632, the second sensor set 640, the sensor subsets 641, 642, the vehicle networks 651, 652, the first micro-controller 615, the micro-controller replicas 615A, 615B, the second micro-controller 625, the micro-controller replicas 625A, 625B, the vehicle 603, the first end 601 and the second end 602.

The system 900 further comprises first and second radios 961, 962 correspondingly coupled to the networks 951, 952, and configured to communicate with a wayside controller 280 and/or a further vehicle 290. For example, each of the first and second radios 961, 962, the wayside controller 280 and the further vehicle 290 has an antenna for such communication which, in at least one embodiment, includes Long Range Wide Area Network (LoRA-WAN) commination. In some embodiments, the first and second radios 961, 962 are configured to perform communication over WiFi, LTE or 5G. In some embodiments, the wayside controller 280 is coupled to a central control external to the vehicle 903 and is configured to transmit additional controls, commands or reports (e.g., traffic or incident reports) from the central control to the vehicle 903 to control movement of the vehicle 903 along the path. In some embodiments, the further vehicle 290 is another vehicle on the same path as the vehicle 903, and is configured to exchange travel and/or traffic information with the vehicle 903 for optimal travels of both vehicles and/or for collision avoidance. Like the sensor sets, both radios 961, 962 are available to each and any of the controller replicas and/or micro-controller replicas for redundancy purposes and/or to ensure a high safety integrity level in communications with the central control and/or other vehicles. In at least one embodiment, one or more advantages described herein are achievable in the system 900.

Figure 10:
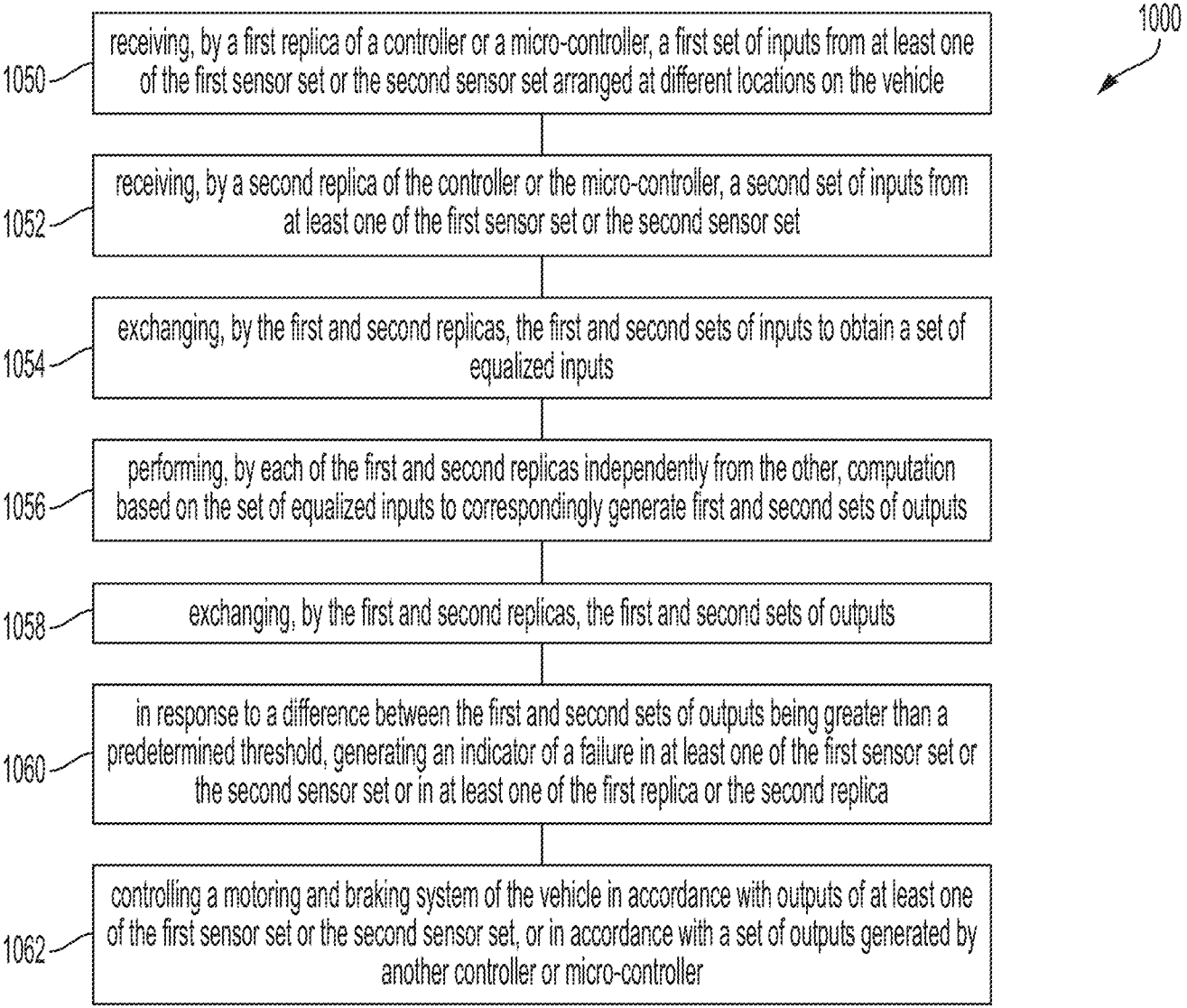
FIG. 10 is flow chart of a method, in accordance with one or more embodiments.

FIG. 10 is flow chart of a method 1000, in accordance with one or more embodiments. In at least one embodiment, the method 1000 is performed by controller replicas or micro-controller replicas as described with respect to FIG. 3 or FIG. 7.

At operation 1050, a first replica of a controller or a micro-controller receives a first set of inputs from at least one of first and second sensor sets. For example, as described with respect to FIGS. 3, 7, the replica 310A or 710A receives a first set of inputs 311 or 711 from sensor subsets at one end, or from sensor subsets at both ends of a vehicle.

At operation 1052, a second replica of the controller or the micro-controller receives a second set of inputs from at least one of first and second sensor sets. For example, as described with respect to FIGS. 3, 7, the replica 310B or 710B receives a second set of inputs 312 or 712 from sensor subsets at one end, or from sensor subsets at both ends of a vehicle.

At operation 1054, the first replica and the second replica exchange the first set of inputs 311, 711 and the second set of inputs to 312, 712 obtain a set of equalized inputs, as described with respect to FIGS. 3, 7.

At operation 1056, each of the first and second replicas perform, independently from the other, computation based on the set of equalized inputs to correspondingly generate first and second sets of outputs. Example computations are described with respect to FIG. 1. The first and second replicas 310A/710A and 310B/710B perform such computations independently of each other to ensure a high safety integrity level, and to generate corresponding outputs 313/713 and 314/714, as described with respect to FIGS. 3, 7.

At operation 1058, the first replica and the second replica exchange the first and second sets of outputs 313/713 and 314/714, as described with respect to FIGS. 3, 7.

At operation 1060, in response to a difference between the first and second sets of outputs 313/713 and 314/714 being greater than a predetermined threshold or predefined tolerance, an indicator of a failure in at least one of the first and second sensor sets, or in at least one of the first replica 310A/710A or the second replica 310B/710B is generated, as described with respect to FIGS. 3, 7.

At operation 1062, the motoring and braking system of the vehicle is controlled in accordance with at least one of first and second sets of outputs 313/713 and 314/714 where the first and second replicas 310A/710A, 310B/710B and the sensor sets are determined to be healthy, as described with respect to FIGS. 3, 7. Otherwise, the motoring and braking system 104 of the vehicle is controlled in accordance with a set of outputs generated by another controller or micro-controller which is available to ensure the system availability. In at least one embodiment, one or more advantages described herein are achievable in the method 1000.

In accordance with other approaches, some railway systems are based on traditional manually driven vehicles following signaling rules conveyed to the vehicle operator via visual signals, or in more modern systems, the signaling rules are controlled and supervised by computers. In accordance with further approaches, some railway systems are capable to operate automatically, i.e., the computer autopilot controls one or more aspects of the vehicle's motoring and braking. However, the other approaches provide no autonomous rail vehicle. In railway systems in accordance with other approaches, vehicles are equipped with sensors such as speed sensors, tachometers, accelerometers, inductive loop cross over readers and/or RFID tag readers. All these sensors are simple sensors in the sense their output signals are simple, easy to understand, explainable signals which do not require excessive processing power in their conversion into meaningful attributes such as speed, position, acceleration, motion direction, guideway direction, orientation and or existence of obstacle in the vehicle's surroundings. By using these types of sensors, the controller in the vehicle in accordance with other approaches does not have an understanding or perception of the environment the vehicle is operated within.

In some embodiments, by equipping the vehicle with sensors, such as radar, LiDAR and/or camera, the controller is capable to "understand" the environment the vehicle is operating within and its perception. Although the sensor outputs are not simple to understand or explainable in some situations and/or the sensor outputs require increased processing power in their conversion into meaningful attributes to understand the environment the vehicle is operating within and its perception, some embodiments provide a control system configuration satisfying these requirements, while achieving a high level of integrity (e.g., SIL 4) with which the odometry, positioning, obstacle avoidance, motion direction, orientation, stationary and cold motion functions are to be delivered.

In some embodiments, autonomous vehicle operations are achievable by combinations of one or more factors, such as sensors, computing elements, vehicle network, and external communication. The sensors are configured to provide measurements with which the computing elements can understand the environment the vehicle is operating within, its perception and deliver the odometry, positioning, obstacle avoidance, motion direction, orientation, stationary and cold motion functions. The computing elements, e.g., controllers, micro-controllers and/or their replicas, are configured to and expected to understand the environment the vehicle is operating within, its perception and to provide the odometry, positioning, obstacle avoidance, motion direction, orientation, stationary and cold motion functions with a high level of integrity (e.g., SIL 4). The vehicle network is configured to provide connectivity between the sensors and the computing elements on-board the vehicle, and to provide sufficient bandwidth for sensors, such as camera or LiDAR, which may require high bandwidth. The external communication is configured to provide connectivity between vehicles (vehicle-to-vehicle communication) and between the vehicle and infrastructure installed on the trackside or central control (vehicle-to-infrastructure communication).

In some embodiments, various advantages are achievable based on one or more of the following aspects (1) sensors integrity, (2) sensors availability, (3) computing platform integrity, (4) computing platform availability, and (5) communication with computers/controllers external to the vehicle.

Sensors integrity corresponds to the minimum number of sensor subsets to provide the odometry, positioning, obstacle avoidance, motion direction, orientation, stationary and cold motion functions with a high level of integrity. In some embodiments, the minimum number of sensor subsets is two (2). When the sensor subsets are of the same type, then a cross comparison between the outputs (e.g., speed, position, collision course, etc.) of the two sensor subsets is performed in one or more embodiments to detect random failures in one (or both) of the sensor subsets. When the two sensor subsets are of different types (i.e., the sensor subsets are dissimilar), then a cross comparison between the outputs (e.g., speed, position, collision course, etc.) of the two sensor subsets is performed in one or more embodiments to detect random failures or faults (due to environment, algorithm limitations, defects, etc.) in one (or both) of the sensor subsets.

In some embodiments, two dissimilar sensor subsets of different types are preferred for one or more reasons. First, the functions integrity argument dependency on the sensors failure modes is minimal to non-existing, because if the two dissimilar sensor subsets are selected in such a way their failure modes are completely non-overlapping (e.g., orthogonal) then the probability of single failure influencing both sensor subsets is improbable (practically negligible). Second, the functions integrity argument dependency on common cause effects is minimal to non-existing, because if the two dissimilar sensor subsets are selected in such a way the influence of environment on the two sensor subsets measurements is orthogonal and the algorithms to determine the speed, position and collision course are dissimilar, then the probability of the same simultaneous adverse influence on both sensor subsets due to environment or algorithm similarity is improbable (practically negligible).

Sensors availability corresponds to sufficient redundancy in the sensors sets to ensure, in one or more embodiments, that in the event of sensor failure, due to random hardware failure, or sensor dysfunction, due to environmental conditions such as weather, the system can continue to operate until the sensor or sensors failure is corrected or the environmental condition resulted in sensor or sensors dysfunction ceases to exist.

Computing platform integrity is ensured by one or more considerations, in one or more embodiments. First, computing platform integrity is ensured by checked redundant architecture in which the computation is performed in two (2) identical computers or computing elements. For example, as described herein, the inputs are equalized between the two computers before the computation begins, then each computer performs the expected computation to completion and then the two (2) computers outputs are compared to check if they are identical. If the two computers outputs are identical, then the output is accepted. However, if the two computers outputs are not identical, and this situation persists for several computing cycles (which is a configurable setting), then the output is not accepted and safe action is to be taken. Second, the checked redundancy architecture can be performed on a single controller or micro-controller, or alternatively, the functions required to generate the safety critical outputs may be partitioned between a controller and a microcontroller which is a different (dissimilar) computer than the controller. The algorithms executed on the microcontroller may be different (dissimilar) than the algorithm executed on the controller to achieve sufficient diversity preventing generation of incorrect hazardous output. Third, the algorithms executed on the controller may be further partitioned (e.g., physically) between the CPU and the GPU/VAT, or between CPU-GPU/VAT pairs to enhance the system computation diversity. In some embodiments, partition between applications and/or functions with different safety integrity levels within the same computer (e.g., CPU, MCU and/or GPU/VAT) may be achieved via safety critical Operating system that ensures space constraints partition (memory partitioning) and/or time constraints partition (temporal partitioning).

Computing platform availability corresponds to ensuring, in one or more embodiments, sufficient redundancy in the computing platforms, such that in the event of computer failure, due to random hardware failure, or computer dysfunction, due to transients in the environmental conditions, the system can continue to operate until the computer or computers failure is corrected or the transient environmental condition resulted in computer or computers dysfunction does not exist anymore.

Communication with computers/controllers/vehicles external to the vehicle is achieved in some embodiments by the controllers and/or microcontrollers on-board the vehicle connected to the vehicle network, which is connected to the radios on-board the vehicle. The on-board radios communicate with the wayside radios (and the wayside network). Therefore the controllers and microcontrollers on-board the vehicle communicate with each other via the vehicle network. Communication to the system external to vehicle is performed via the radios.

Some embodiments provide a CBTC with an on-board system configured to determine its position, speed and motion direction on the guideway. In particular, at least one embodiment provides an autonomous train in which the train has perception of the environment it operates within and is configured to take actions to ensure the system safety integrity and availability as designed.

In some embodiments that are suitable for autonomous vehicles other than trains, due to the capability to determine the vehicle position, speed and motion direction together with the perception of the environment the vehicle operates within including, but not limited to, objects detection, tracking and decision if the tracked object is in collision course with the vehicle of interest.

In some embodiments, a system for controlling a vehicle is still available under any combination of two sensor failures, as the sensors are connected to the vehicle network and available to all controllers on-board the vehicle. In contrast, in the known approaches, some combinations of two sensor failures can result in system non-availability if one failed sensor is associated with a first controller and the other failed sensor is associated with a second controller.

In some embodiments, each function, such as, obstacle avoidance, motion direction, orientation, stationary and cold motion is defined and achieved with a high (e.g., SIL 4) level of integrity, based on at least two (2) independent sensor subsets using dissimilar and diverse sensing technologies and computation algorithms.

In some embodiments, the computer used to configure each controller's or micro-controller's replica has sufficient computing performance to compute machine vision, neural network and fusion between sensors algorithms for the autonomous train application.

In some embodiments, the computer used to configure each controller's or micro-controller's replica has sufficient physical independence between computing elements executing high safety integrity (SIL 4) functions and computing elements executing low or no safety integrity level function. Physical independence, in one or more embodiments, means separate and isolated power supplies and separate and isolated communication links. A sensor fusion algorithm for positioning is an example of a function that has no or low safety integrity level. Such an algorithm is a complex algorithm with safety properties that might be difficult to demonstrate. The sensor fusion algorithm is supervised by a simpler algorithm (e.g., a protection level) having safety properties that are easier to demonstrate. In at least one embodiment, the sensor fusion algorithm is executed by a controller replica whereas the supervising algorithm is executed by a micro-controller replica. As the controller replica is physically independent from the micro-controller replica, high safety integrity (Sit) partitioning is achieved.

In some embodiments, sufficient memory space and temporal isolation barrier between high safety integrity level functions and low or no safety integrity function executed on the same computing element is achieved.

In some embodiments, system availability with high safety integrity level of the obstacle avoidance, motion direction, orientation, stationary and cold motion functions is ensured under any combination of two sensors failure.

In some embodiments, under no failure conditions, the main safety concepts are checked redundancy and diversity/dissimilarity of sensor sets/subsets and/or computing elements/replicas, while under failure conditions, the dominant safety concept is diversity/dissimilarity of sensor sets/subsets and/or computing elements/replicas.

In some embodiments, a high level (SIL) of safety integrity is advantageously achieved by diversity in the sensors measurement technologies and/or diversity in the algorithms and software implemented to deliver the functions outputs and/or space and temporal partitioning between functions with high level of safety integrity and functions with low or no level of safety integrity.

In some embodiments, a high level of system availability is advantageously achieved because sensors measurements are available (on the vehicle network) to any on-board controller (computer).

In some embodiments, a high processing capacity suitable to execute algorithms such as machine vision, neural networks and fusion between sensors is advantageously achieved.

Figure 11:
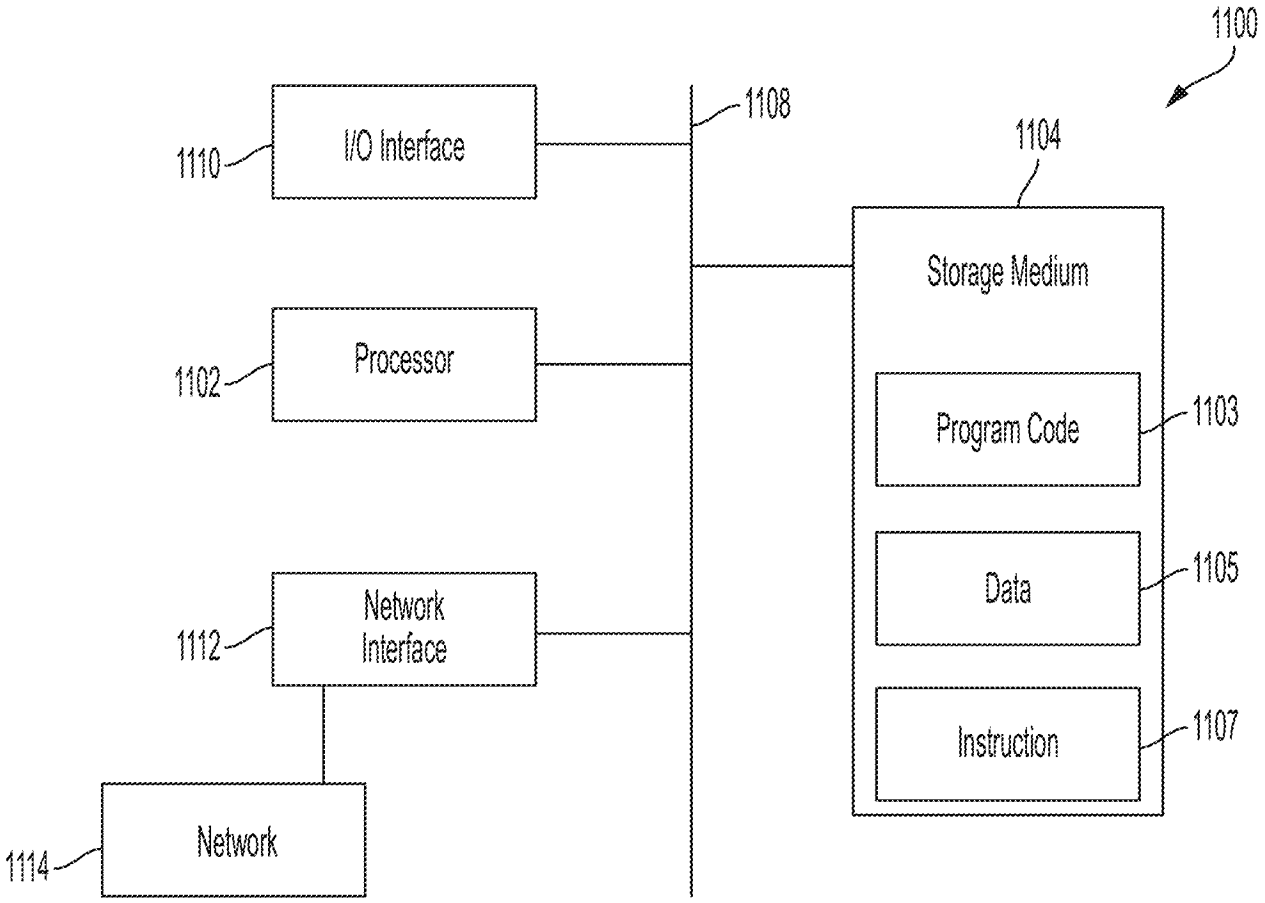
FIG. 11 is a schematic block diagram of a computing platform, in accordance with one or more embodiments.

FIG. 11 is a block diagram of a computing platform 1100, in accordance with one or more embodiments. In some embodiments, one or more of the controller 110, first controller 311, second controller 321, a VOBC of any one or more of the vehicle 103, leading vehicle 310 and trailing vehicle 320 is/are implemented as one or more computing platform(s) 1100.

The computing platform 1100 includes a specific-purpose hardware processor 1102 and a non-transitory, computer readable storage medium 1104 storing computer program code 1103 and/or data 1105. The computer readable storage medium 1104 is also encoded with instructions 1107 for interfacing with the vehicle on which the computing platform 1100 is installed. The processor 1102 is electrically coupled to the computer readable storage medium 1104 via a bus 1108. The processor 1102 is also electrically coupled to an I/O interface 1110 by the bus 1108. A network interface 1112 is electrically connected to the processor 1102 via the bus 1108. The network interface 1112 is connected to a network 1114, so that the processor 1102 and/or the computer readable storage medium 1104 is/are connectable to external elements and/or systems via the network 1114.

In some embodiments, the processor 1102 is a central processing unit (CPU), a multi-processor, a distributed processing system, an application specific integrated circuit (ASIC), and/or a suitable hardware processing unit.

In some embodiments, the processor 1102 is configured to execute the computer program code 1103 and/or access the data 1105 stored in the computer readable storage medium 1104 in order to cause the computing platform 1100 to perform as one or more components of the system 100 and/or system 300, and/or to perform a portion or all of the operations as described in one or more of the methods 400, 500, 600 and 700. For example, the computer program code 1103 includes one or more algorithm or model for causing the processor 1102 to solve optimization problems or estimate a parameter of the vehicle. The computer readable storage medium 1104 includes one or more of the trip limits and objectives database 130, track database 140 and vehicle configuration database 150 with at least one control objective and one or more constraints for the optimization problems and/or parameter estimation.

In some embodiments, the processor 1102 is hard-wired (e.g., as an ASIC) to cause the computing platform 1100 to perform as one or more components of the system 100 and/or system 300, and/or to perform a portion or all of the operations as described in one or more of the methods 400, 500, 600 and 700.

In some embodiments, the computer readable storage medium 1104 is an electronic, magnetic, optical, electromagnetic, infrared, and/or a semiconductor system (or apparatus or device). For example, the computer readable storage medium 1104 includes a semiconductor or solid-state memory, a magnetic tape, a removable computer diskette, a random access memory (RAM), a read-only memory (ROM), a rigid magnetic disk, and/or an optical disk. In some embodiments using optical disks, the computer readable storage medium 1104 includes a compact disk-read only memory (CD-ROM), a compact disk-read/write (CD-R/W), and/or a digital video disc (DVD).

In some embodiments, the I/O interface 1110 is coupled to external circuitry. In some embodiments, the I/O interface 1110 includes a keyboard, keypad, mouse, trackball, trackpad, and/or cursor direction keys for communicating information and commands to processor 1102. In at least one embodiment, the I/O interface 1110 is coupled to a communication circuit for vehicle-to-vehicle communication as described with respect to FIG. 3.

In some embodiments, the network interface 1112 allows the computing platform 1100 to communicate with network 1114, to which one or more other computing platforms are connected. The network interface 1112 includes wireless network interfaces such as BLUETOOTH, WIFI, LTE, 5G, WIMAX, GPRS, or WCDMA; or wired network interface such as ETHERNET, USB, or IEEE-1394. In some embodiments, the method 300A and/or method 300B is/are implemented in two or more computing platforms 1100, and various executable instructions and/or data are exchanged between different computing platforms 1100 via the network 1114.

By being configured to execute some or all of functionalities and/or operations described with respect to FIGS. 1-7, the computing platform 1100 enables the realization of one or more advantages and/or effects described with respect to FIGS. 1-7.

In some embodiments, a system for controlling a vehicle comprises at least one vehicle network on board the vehicle, first and second controllers coupled to the at least one vehicle network and configured to communicate with each other via the at least one vehicle network, and first and second sensor sets coupled to the at least one vehicle network, and configured to communicate with any of the first and second controllers via the at least one vehicle network. Each of the first and second controllers is configured to, based on data output from any of the first and second sensor sets, control a movement of the vehicle independently of the other of the first and second controllers. The first sensor set is located at a first location on the vehicle, the second sensor set is located at a second location on the vehicle, and the second location is different from the first location.

In some embodiments, a method of controlling a vehicle comprises receiving, by a first replica of a controller or a micro-controller, a first set of inputs from at least one of the first sensor set or the second sensor set arranged at different locations on the vehicle; receiving, by a second replica of the controller or the micro-controller, a second set of inputs from at least one of the first sensor set or the second sensor set; exchanging, by the first and second replicas, the first and second sets of inputs to obtain a set of equalized inputs; performing, by each of the first and second replicas independently from the other, computation based on the set of equalized inputs to correspondingly generate first and second sets of outputs; exchanging, by the first and second replicas, the first and second sets of outputs; in response to a difference between the first and second sets of outputs being greater than a predetermined threshold, generating an indicator of a failure in at least one of the first sensor set or the second sensor set or in at least one of the first replica or the second replica; and controlling a motoring and braking system of the vehicle in accordance with at least one of the first set of outputs or the second set of outputs, or in accordance with a set of outputs generated by another controller or micro-controller.

In some embodiments, a sensor system for a vehicle comprises a first sensor set located at a first location on the vehicle, and couplable to at least one vehicle network on board the vehicle, and a second sensor set located at a second location on the vehicle, and couplable to the at least one vehicle network. The second location is spaced from the first location along a length direction or a travel direction of the vehicle. Each of the first and second sensor sets comprises a first sensor subset and a second sensor subset. The first sensor subset is configured to output a set of measured values of a plurality of parameters. The second sensor subset is configured to output a further set of measured values of the plurality of parameters. The second sensor subset is different from the first sensor subset in at least one of a different sensor type, a different frequency band, a different sensing technology, or a different sensing principle.

It will be readily seen by one of ordinary skill in the art that the disclosed embodiments fulfill one or more of the advantages set forth above. After reading the foregoing specification, one of ordinary skill will be able to affect various changes, substitutions of equivalents and various other embodiments as broadly disclosed herein. It is therefore intended that the protection granted hereon be limited only by the definition contained in the appended claims and equivalents thereof.

What is claimed is:

1. A system for controlling a vehicle, comprising:

at least one vehicle network on board the vehicle;

first and second controllers coupled to the at least one vehicle network and configured to communicate with each other via the at least one vehicle network; and first and second sensor sets coupled to the at least one vehicle network, and configured to communicate with each and any of the first and second controllers via the at least one vehicle network, wherein each of the first and second controllers is configured to, based on data output from any of the first and second sensor sets, control a movement of the vehicle independently of the other of the first and second controllers, and the first sensor set is located at a first location on the vehicle, the second sensor set is located at a second location on the vehicle, and the second location is different from the first location.

2. The system of claim 1, wherein the vehicle is a railway vehicle, the first location where the first sensor set is located is at one of a leading end and a trailing end of the railway vehicle, and the second location where the second sensor set is located is at the other of the leading end and the trailing end of the railway vehicle.

3. The system of claim 1, wherein each of the first and second controllers comprises first and second replicas, and the at least one vehicle network comprises a first network coupled to the first replicas of the first and second controllers, and a second network coupled to the second replicas of the first and second controllers.

4. The system of claim 3, wherein each of the first and second sensor sets comprises first and second identical sensor subsets, the first network is coupled to both the first and second sensor subsets of the second sensor set, and the second network is coupled to both the first and second sensor subsets of the first sensor set.

5. The system of claim 3, wherein each of the first and second sensor sets comprises first and second identical sensor subsets, the first network is coupled to one of the first and second sensor subsets of the first sensor set, and one of the first and second sensor subsets of the second sensor set, and the second network is coupled to the other of the first and second sensor subsets of the first sensor set, and the other of the first and second sensor subsets of the second sensor set.

6. The system of claim 3, wherein, in each of the first and second controllers, the first replica is configured to receive a first set of inputs from at least one of the first sensor set or the second sensor set via the first network, the second replica is configured to receive a second set of inputs from at least one of the first sensor set of the second sensor set via the second network, the first and second replicas are configured to exchange the first and second sets of inputs to obtain a set of equalized inputs, perform computation based on the set of equalized inputs to correspondingly generate first and second sets of outputs for controlling the movement of the vehicle, exchange the first and second sets of outputs, and in response to a difference between the first and second sets of outputs, generate an indicator of a failure in at least one of the first sensor set or the second sensor set.

7. The system of claim 3, wherein each of the first and second sensor sets comprises a first sensor subset and a second sensor subset, the first sensor subset is configured to output a set of measured values of a plurality of parameters, and the second sensor subset is configured to output a further set of measured values of the plurality of parameters.

8. The system of claim 7, wherein, in each of the first and second sensor sets, the second sensor subset is different from the first sensor subset in at least one of a different sensor type, a different frequency band, a different sensing technology, or a different sensing principle.

9. The system of claim 8, wherein the first network is coupled to both the first and second sensor subsets of the second sensor set, and the second network is coupled to both the first and second sensor subsets of the first sensor set.

10. The system of claim 8, wherein the first network is coupled to one of the first and second sensor subsets of the first sensor set, and one of the first and second sensor subsets of the second sensor set, and the second network is coupled to the other of the first and second sensor subsets of the first sensor set, and the other of the first and second sensor subsets of the second sensor set.

11. The system of claim 8, wherein the first sensor subset of the first sensor set is identical to one of the first sensor subset and the second sensor subset of the second sensor set, and the second sensor subset of the first sensor set is identical to the other of the first sensor subset and the second sensor subset of the second sensor set.

12. The system of claim 7, wherein, in each of the first and second sensor sets, each of the first and second sensor sets comprises:

a plurality of sensors configured to detect the plurality of parameters, and a plurality of micro-controllers each coupled to a corresponding sensor among the plurality of sensors, without being coupled to another sensor among the plurality of sensors, and coupled to either the first network or the second network to output a measured value of a parameter, among the plurality of parameters, detected by the corresponding sensor.

13. The system of claim 7, wherein, in each of the first and second sensor sets, each of the first and second sensor sets comprises:

a plurality of sensors configured to detect the plurality of parameters, and a plurality of micro-controllers each coupled to multiple sensors among the plurality of sensors, configured to cross-check measured values output by the multiple sensors, and output the cross-check measured values to either the first network or the second network.

14. The system of claim 7, further comprising:

first and second micro-controllers each comprising first and second replicas, wherein the first network is coupled to the first replicas of the first and second micro-controllers, the second network coupled to the second replicas of the first and second micro-controllers, the first replica of the first micro-controller is different from the first replica of the first controller in at least one of a processor, a memory or an instruction set, and is configured to execute an algorithm to supervise other algorithms executed in the first replica of the first controller, the second replica of the first micro-controller is different from the second replica of the first controller in at least one of a processor, a memory or an instruction set, and is configured to execute an algorithm to supervise other algorithms executed in the second replica of the first controller, the first replica of the second micro-controller is different from the first replica of the second controller in at least one of a processor, a memory or an instruction set, and is configured to execute an algorithm to supervise other algorithms executed in the first replica of the second controller, and the second replica of the second micro-controller is different from the second replica of the second controller in at least one of a processor, a memory or an instruction set, and is configured to execute an algorithm to supervise other algorithms executed in the second replica of the second controller.

15. The system of claim 14, wherein, in each of the first and second micro-controllers, the first replica is configured to receive a first set of inputs from at least one of the first sensor set or the second sensor set via the first network, the second replica is configured to receive a second set of inputs from at least one of the first sensor set or the second sensor set via the second network, the first and second replicas are configured to exchange the first and second sets of inputs to obtain a set of equalized inputs, perform computation based on the set of equalized inputs to correspondingly generate first and second sets of outputs for controlling the movement of the vehicle, exchange the first and second sets of outputs, and in response to a difference between the first and second sets of outputs, generate an indicator of a failure in at least one of the first sensor set or the second sensor set.

16. The system of claim 14, further comprising:

a first radio coupled to the first network and configured to communicate the first replicas of the first and second micro-controllers and the first and second controllers to an external control or a further vehicle; and a second radio coupled to the second network and configured to communicate the second replicas of the first and second micro-controllers and the first and second controllers to the external control or a further vehicle.

17. The system of claim 3, wherein each of the first and second replicas of each of the first and second controllers comprises:

m micro-controllers, where m is a natural number not smaller than 2, n processors, where n is a natural number not smaller than 2, l clusters of Graphics Processing Unit/Vector Arithmetic Accelerator (GPU/VAT), where l is a natural number not smaller than 2, a first bus to which the m micro-controllers and the n processors are coupled, and a second bus to which the n processors and the/clusters of GPU/VAT are coupled.

18. A method of controlling a vehicle, the method comprising:

receiving, by a first replica of a controller or a micro-controller, a first set of inputs from at least one of a first sensor set or a second sensor set arranged at different locations on the vehicle;

receiving, by a second replica of the controller or the micro-controller, a second set of inputs from at least one of the first sensor set or the second sensor set;

exchanging, by the first and second replicas, the first and second sets of inputs to obtain a set of equalized inputs;

performing, by each of the first and second replicas independently from the other, computation based on the set of equalized inputs to correspondingly generate first and second sets of outputs;

exchanging, by the first and second replicas, the first and second sets of outputs;

in response to a difference between the first and second sets of outputs, generating an indicator of a failure in at least one of the first sensor set or the second sensor set or in at least one of the first replica or the second replica; and controlling a motoring and braking system of the vehicle in accordance with at least one of the first set of outputs or the second set of outputs, or in accordance with a set of outputs generated by another controller or micro-controller.

19. A sensor system for a vehicle, the sensor system comprising:

a first sensor set located at a first location on the vehicle, and couplable to at least one vehicle network on board the vehicle; and a second sensor set located at a second location on the vehicle, and couplable to the at least one vehicle network, wherein the second location is spaced from the first location along a length direction or a travel direction of the vehicle, each of the first and second sensor sets comprises a first sensor subset and a second sensor subset, the first sensor subset is configured to output a set of measured values of a plurality of parameters, the second sensor subset is configured to output a further set of measured values of the plurality of parameters, the second sensor subset is different from the first sensor subset in at least one of a different sensor type, a different frequency band, a different sensing technology, or a different sensing principle, and each of the set of measured values and the further set of measured values includes sufficient sensor data for a controller of the vehicle to perform a plurality of functions for controlling movement of the vehicle.

20. The sensor system of claim 19, wherein the plurality of functions comprises odometry, positioning, obstacle avoidance, and stationary status, the first location where the first sensor set is located is at one of a leading end and a trailing end of the vehicle which is a railway vehicle, and the second location where the second sensor set is located is at the other of the leading end and the trailing end of the railway vehicle.

* * * * *